US007909018B2

(12) United States Patent
Ishiguro et al.

(10) Patent No.: US 7,909,018 B2
(45) Date of Patent: Mar. 22, 2011

(54) CONTROL FOR DETERMINING A FIRING TIMING OF AN INTERNAL-COMBUSTION ENGINE

(75) Inventors: Tetsuya Ishiguro, Saitama (JP); Shusuke Akazaki, Saitama (JP); Yuji Yamamoto, Saitama (JP)

(73) Assignee: Honda Motor Co., Ltd., Minato-Ku, Tokyo (JP)

( * ) Notice: Subject to any disclaimer, the term of this patent is extended or adjusted under 35 U.S.C. 154(b) by 273 days.

(21) Appl. No.: 12/222,782

(22) Filed: Aug. 15, 2008

(65) Prior Publication Data

US 2009/0055074 A1 Feb. 26, 2009

(30) Foreign Application Priority Data

Aug. 21, 2007 (JP) ..... 2007-215182

(51) Int. Cl.
*F02P 5/00* (2006.01)

(52) U.S. Cl. ..... 123/406.11; 123/406.41

(58) Field of Classification Search ..... 123/406.11, 123/406.41
See application file for complete search history.

(56) References Cited

U.S. PATENT DOCUMENTS

| | | | | |
|---|---|---|---|---|
| 7,238,133 | B2 * | 7/2007 | Tabata et al. | 475/5 |
| 7,552,003 | B2 * | 6/2009 | Suzuki et al. | 701/51 |
| 2004/0035622 | A1 * | 2/2004 | Ito et al. | 180/197 |
| 2005/0005914 | A1 * | 1/2005 | Tamechika et al. | 123/478 |

FOREIGN PATENT DOCUMENTS

| | | |
|---|---|---|
| JP | 2000-234558 | 8/2000 |
| JP | 2005-076484 | 3/2005 |
| JP | 2006-242146 | 9/2006 |

* cited by examiner

*Primary Examiner* — John T Kwon
(74) *Attorney, Agent, or Firm* — Squire, Sanders & Dempsey (US) LLP

(57) ABSTRACT

A control for determining a firing timing of an engine is provided. An in-cylinder pressure is detected at a predetermined time interval. An in-cylinder pressure for every predetermined crank angle is calculated based on the detected in-cylinder pressure. A motoring pressure in a case where combustion is not performed in the engine is estimated. It is detected that a pressure difference between the calculated in-cylinder pressure and the motoring pressure has exceeded a determination value. A time point is identified, as a firing timing, at which the pressure difference has exceeded a determination value with a finer resolution than the resolution of the predetermined crank angle interval through an interpolation calculation. The interpolation calculation uses a first crank angle when it is detected that the pressure difference has exceeded the determination value, the pressure difference corresponding to the first crank angle, a second crank angle previous to the first crank angle by the predetermined crank angle and a pressure difference corresponding to the second crank angle.

4 Claims, 19 Drawing Sheets

CONTROL FOR DETERMINING A FIRING TIMING OF AN INTERNAL-COMBUSTION ENGINE

BACKGROUND OF THE INVENTION

The present invention relates to a control for determining a firing timing of an internal-combustion engine (which will be hereinafter referred to as an "engine").

Conventionally, a technique for determining a firing timing or a firing delay in an engine has been proposed. For example, Japanese Patent Application Publication No. 2006-242146 proposes a technique for determining a firing timing or a firing delay based on a difference between a pressure (in-cylinder pressure) in a combustion chamber of an engine which is measured during a compression stroke and an estimated value for a pressure in the combustion chamber in a case where a misfire occurs (such a pressure is referred to as a "motoring pressure").

Based on the determined firing timing, operating parameters for the engine may be calculated and/or various controls such as a fuel control, an ignition timing control or the like in the engine may be performed. In order to improve the accuracy of such controls, it is desirable to improve the accuracy in determining the firing timing.

SUMMARY OF THE INVENTION

According to one aspect of the present invention, a control for determining a firing timing of an engine is provided. An in-cylinder pressure of the engine is detected at a predetermined time interval. An in-cylinder pressure for every predetermined crank angle is calculated based on the in-cylinder pressure detected at the predetermined time interval. A motoring pressure in a case where combustion is not performed in the engine is estimated. It is detected that a pressure difference between the calculated in-cylinder pressure and the motoring pressure has exceeded a determination value. A time point at which the pressure difference has exceeded the determination value is identified as a firing timing with a finer resolution than the resolution of the predetermined crank angle by an interpolation calculation. Here, the interpolation calculation uses a first crank angle at which it is detected the pressure difference between the calculated in-cylinder pressure and the motoring pressure has exceeded the determination value, the pressure difference corresponding to the first crank angle, a second crank angle previous to the first crank angle by the predetermined crank angle, and a pressure difference corresponding to the second crank angle.

Thus, a firing timing can be identified with a finer resolution than a crank angle interval at which the in-cylinder pressure is calculated. The in-cylinder pressure for every desired crank angle is calculated regardless of the time interval at which the in-cylinder pressure is detected. Accordingly, the in-cylinder pressure can be calculated at a finer crank angle interval without increasing the sampling frequency of the in-cylinder pressure. Because the resolution of the in-cylinder pressure is increased, the resolution of the firing timing can be improved.

According to one embodiment of the invention, a pressure difference between the in-cylinder pressure at a heat release time point at which heat is generated and the motoring pressure at the heat release time point is estimated based on the motoring pressure at a compression top dead center. The estimated pressure difference is used as the determination value. Thus, a pressure difference at a time at which heat is generated can be estimated based on the motoring pressure at a compression top dead center. Because the heat is generated in response to the firing, the firing timing can be determined by using the estimated pressure difference as the determination value.

According to another aspect of the present invention, a control for determining a firing timing of an engine is provided. An in-cylinder pressure of the engine is detected at a predetermined time interval. An in-cylinder pressure for every predetermined crank angle is calculated based on the in-cylinder pressure detected at the predetermined time interval. A heat release amount is calculated based on the calculated in-cylinder pressure. It is detected that the heat release amount has exceeded a predetermined value. A time point at which the heat release amount has exceeded the predetermined value is identified as a firing timing with a finer resolution than the resolution of the predetermined crank angle by an interpolation calculation. Here, the interpolation calculation uses a first crank angle at which it is detected that the heat release amount has exceeded the predetermined value, the heat release amount corresponding to the first crank angle, a second crank angle previous to the first crank angle by the predetermined crank angle, and a heat release amount corresponding to the second crank angle.

Thus, a firing timing can be identified with a finer resolution than the crank angle interval at which the in-cylinder pressure is calculated. The in-cylinder pressure for every desired crank angle is calculated regardless of the time interval at which the in-cylinder pressure is detected. Accordingly, the in-cylinder pressure can be calculated at a finer crank angle interval without increasing the sampling frequency for the in-cylinder pressure. Because the resolution of the in-cylinder pressure is increased, the resolution of the firing timing is improved.

According to one embodiment of the invention, update of the firing timing is prohibited if a crank angle corresponding to the firing timing is earlier than a predetermined value. Thus, it is prevented that the firing timing that may contain an error is used in a subsequent process. For example, the firing timing may contain an error in a case where the firing timing is earlier than the ignition timing. In such a case, update of the firing timing can be prohibited.

According to another embodiment of the invention, it is determined that a misfire has occurred if a time point to be identified as the firing timing is not found out over a predetermined period. Thus, presence/absence of a misfire can be determined in a firing timing determination process.

DESCRIPTION OF THE PREFERRED EMBODIMENTS

Some embodiments of the present invention will be described below referring to the accompanying drawings.

Figure 1:
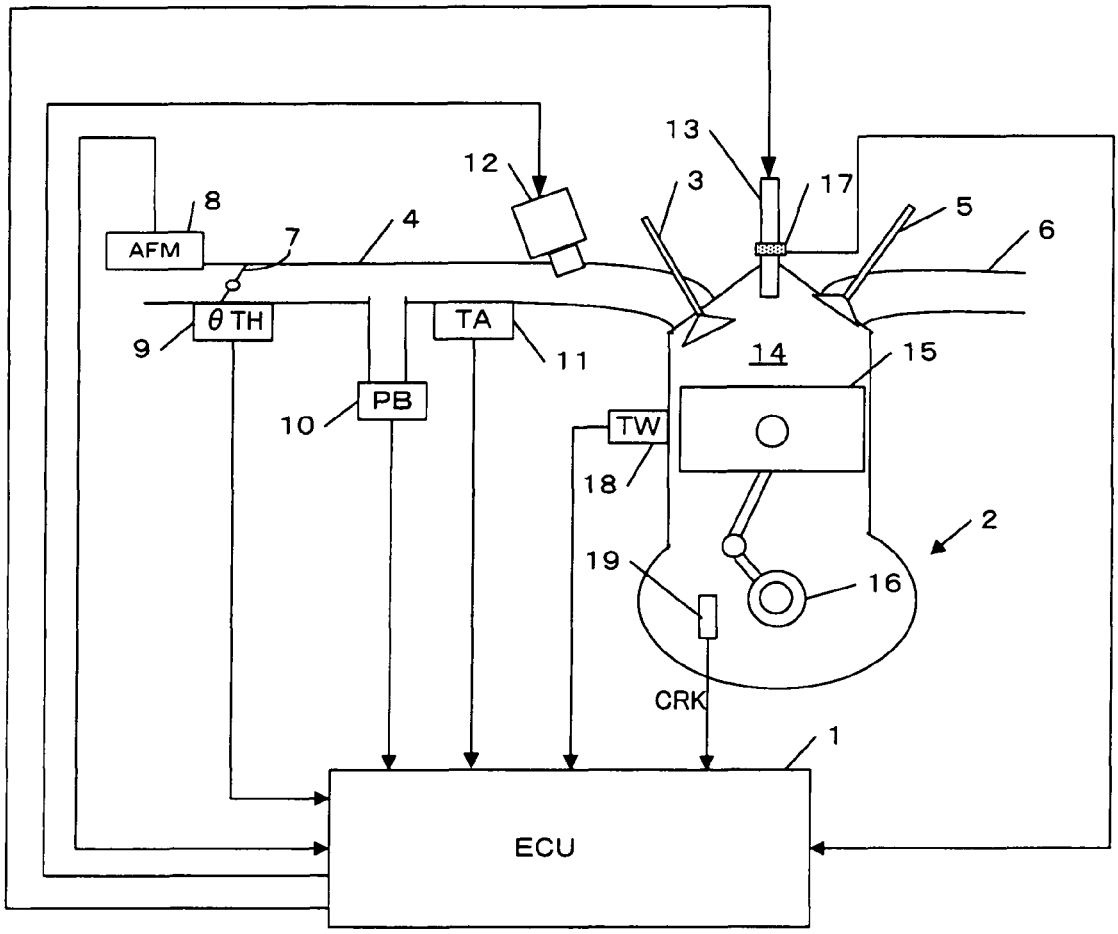
FIG. 1 is a block diagram showing an overall structure of an engine and its control unit in accordance with one embodiment of the present invention.

FIG. 1 is a block diagram showing an overall structure of an engine and its control unit in accordance with one embodiment of the present invention. An electronic control unit (hereinafter referred to as an "ECU") 1 is a computer having an input/output interface, a central processing unit (CPU) and a memory. One or more computer programs for implementing various controls for the vehicle and data required for executing the programs may be stored in the memory. One or more computer programs for determining a firing timing and data required for determining a firing timing according to the invention may be stored in the memory. The ECU 1 receives data sent from each section of the vehicle through the input/output interface and performs calculations using the received data to generate control signals to be sent through the input/output interface to each section of the vehicle for controlling each section.

An engine 2 is, for example, an engine having four cylinders. One of the cylinders is shown in FIG. 1. Each cylinder is connected to an intake manifold 4 through an intake valve 3 and is connected to an exhaust manifold 6 through an exhaust valve 5.

An airflow meter (AFM) 8 is provided in the intake manifold 4. The airflow meter 8 detects the amount of air passing through the intake manifold 4 via a throttle valve 7. The detection value of the airflow meter 8 is sent to the ECU 1.

An opening degree of the throttle valve 7 is controlled in accordance with a control signal from the ECU 1. By controlling the opening degree of the throttle valve 7, the amount of air to be taken into the engine 2 can be controlled. A throttle valve opening (θTH) sensor 9 for detecting the opening degree of the throttle valve is connected to the throttle valve 7. The detection value of the throttle valve opening sensor is sent to the ECU 1.

An intake manifold absolute pressure (PB) sensor 10 and an intake air temperature (TA) sensor 11 are provided downstream of the throttle valve 7 to detect a pressure and a temperature within the intake manifold, respectively. The detection values of these sensors are sent to the ECU 1.

A fuel injection valve (injector) 12 is provided for each cylinder in the intake manifold 4 of the engine 2. The fuel injection valve 12 injects fuel in accordance with a control signal from the ECU 1.

A spark plug 13 is attached in such a manner as to protrude into the combustion chamber 14. In order to perform the ignition operation, the spark plug 13 is driven in accordance with an ignition timing indicated by a control signal from the ECU 1.

A spark generated by the spark plug 13 enables a mixture of the fuel injected from the fuel injection valve 12 and the air to burn inside the combustion chamber 14. The volume of the air-fuel mixture increases through the combustion, so that the piston 15 is pushed downward. The reciprocating movement of the piston 15 is converted to a rotational movement of the crankshaft 16.

An in-cylinder pressure sensor 17 is embedded in the spark plug 13 of each cylinder. The sensor 17 is a plug-in type sensor that uses a piezo-electric element to detect a pressure (in-cylinder pressure) applied to a protrusion portion of the spark plug 13 into the combustion chamber 14. The sensor 17 sends the detected in-cylinder pressure to the ECU 1.

The engine 2 is provided with a water temperature sensor 18 for detecting a temperature TW of the cooling water of the engine 2 and a crank angle sensor 19. The crank angle sensor 19 outputs a CRK signal (crank pulse) to the ECU 1 in accordance with rotation of the crankshaft 16. The CRK signal is output at every predetermined crank angle (for example, every 15 degrees). The ECU 1 calculates a rotational speed NE of the engine 2 in accordance with the CRK signal.

Figure 2:
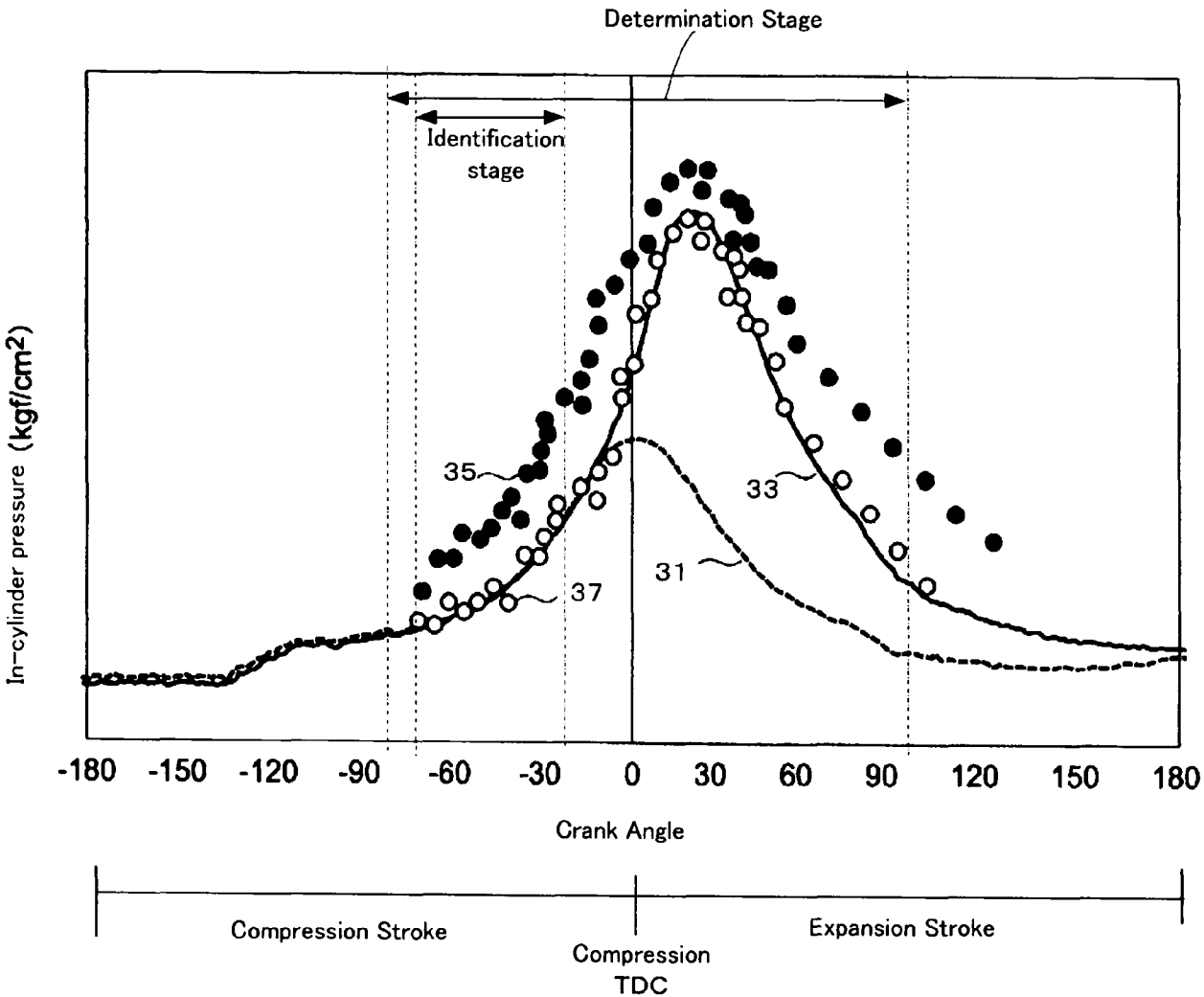
FIG. 2 shows a motoring pressure curve and a pressure curve when combustion is performed.

Now, an outline of a firing timing determining process that is performed in accordance with one embodiment of the present invention will be described referring to FIG. 2 and FIG. 3. FIG. 2 shows a pressure in the combustion chamber of a cylinder (that is, in-cylinder pressure) in a range of −180 degrees to 180 degrees of crank angle. The range of about −180 degrees to 0 degree of crank angle is a compression stroke and the range of about 0 degree to 180 degrees of crank angle is an expansion (combustion) stroke.

Curve 31 shows a behavior of a motoring pressure (which is a pressure in a case of misfire) of one cylinder of the engine. Curve 33 shows a behavior of an in-cylinder pressure in normal combustion in the same cylinder. The crank angle of 0 degree is a Top Dead Center (TDC). The motoring pressure in a case of misfire reaches a peak at the TDC and the in-cylinder pressure in a case of combustion reaches a peak in the vicinity of 10 degrees after the TDC.

As shown in FIG. 2, during a period before the TDC in the compression stroke (for example, during a period that is indicated by "identification stage"), curve 31 and curve 33 almost overlap each other, which indicates that the motoring pressure and the in-cylinder pressure take almost the same values.

On the other hand, black dots 35 indicate actual measurement values PS that are detected from the in-cylinder pressure sensor 17. Because the in-cylinder pressure sensor 17 is disposed in a very severe environment in the combustion chamber of the engine, the characteristic of the sensor may change due to the influence of the temperature, aging deterioration or the like. Therefore, as shown in FIG. 2, the in-cylinder pressure actual measurement values PS may contain an error and deviate from the curve 33 that indicates the in-cylinder pressure containing no error.

In this embodiment, correction parameters for correcting the actual measurement values are identified in the identification stage such that the in-cylinder pressure actual measurement values PS follow the curve 31 of the motoring pressure. More specifically, this correction is performed by applying the following correction equation to the in-cylinder pressure actual measurement value PS.

$$PS'(\theta)=PS(\theta)k1+C1$$

Here, k1 represents a correction coefficient (gain) and C1 represents a correction term (offset). k1 and C1 are the correction parameters. θ represents a crank angle. Such corrected actual measurement values PS' are shown by white dots 37 in FIG. 2. In the period of the identification stage, as described above, because the in-cylinder pressure containing no error (Curve 33) exhibits almost the same behavior as the motoring pressure (Curve 31), the in-cylinder pressure actual measurement value PS should converge to the corresponding motoring pressure PM through the correction operation. Therefore, the correction parameters k1 and C1 are identified in the period of the identification stage such that a difference (PM−PS') between the motoring pressure PM and the corrected in-cylinder pressure PS' is minimum.

Then, during a period including a combustion (expansion) stroke in which the air-fuel mixture is fired and burned in response to the ignition operation (for example, during a period that is indicated by "determination stage" in FIG. 2), the in-cylinder pressure actual measurement value PS is corrected by using the identified correction parameters k1 and C1 so as to calculate the corrected in-cylinder pressure PS'. Through this correction, the black dots 35 in the determination stage become the white dots 37 which are located almost on the curve 33. As shown in FIG. 2, when the combustion is actually started by the firing, a difference (which is a combustion pressure) between the corrected in-cylinder pressure PS' (Curve 33) and the motoring pressure PM (Curve 31) occurs and the magnitude of the difference increases as the combustion proceeds.

Now, referring to FIG. 3, two embodiments for determining a firing (start of actual combustion after the ignition operation) will be described. FIG. 3(*a*), which is similar to FIG. 2, shows behaviors of the corrected in-cylinder pressure PS' (Curve 33) and the motoring pressure PM (Curve 31) in a predetermined period. As described above, when actual combustion is started by the air-fuel mixture being fired, a pressure difference PCOMB occurs between the corrected in-cylinder pressure PS' (Curve 33) and the motoring pressure PM (Curve 31). According to a first embodiment, the pressure difference PCOMB is monitored over the period of the determination stage and a time point at which the pressure difference PCOMB exceeds a determination value DP is determined as a firing timing (start time of actual combustion).

The determination value DP is preferably determined to correspond to a difference pressure at a heat release time point. The heat release time point represents a time point at which the amount of heat release reaches a predetermined amount. Because the amount of heat release increases in response to the firing, the firing timing can be determined if the heat release time point is found.

According to findings by the inventors of the present invention, the pressure difference PCOMB between the corrected in-cylinder pressure PS' and the motoring pressure PM at the heat release time point (that is, the determination value DP) can be estimated from the motoring pressure at the compression TDC. More specifically, the pressure difference DP at the heat release time point can be approximated by the motoring pressure at the compression TDC×a (%) (for example, "a" is 5). In other words, the motoring pressure at the top dead center represents a maximum in-cylinder pressure in a case where the combustion is not being performed. Because the combustion pressure and the heat release amount are correlated, a time point at which a combustion pressure equivalent to a predetermined proportion of the above maximum in-cylinder pressure is generated by the combustion can be regarded as a time point at which a predetermined heat release amount is generated. According to this approach, calculation or detection of the heat release amount is not required because the heat release time point can be estimated from the motoring pressure.

Figure 3:
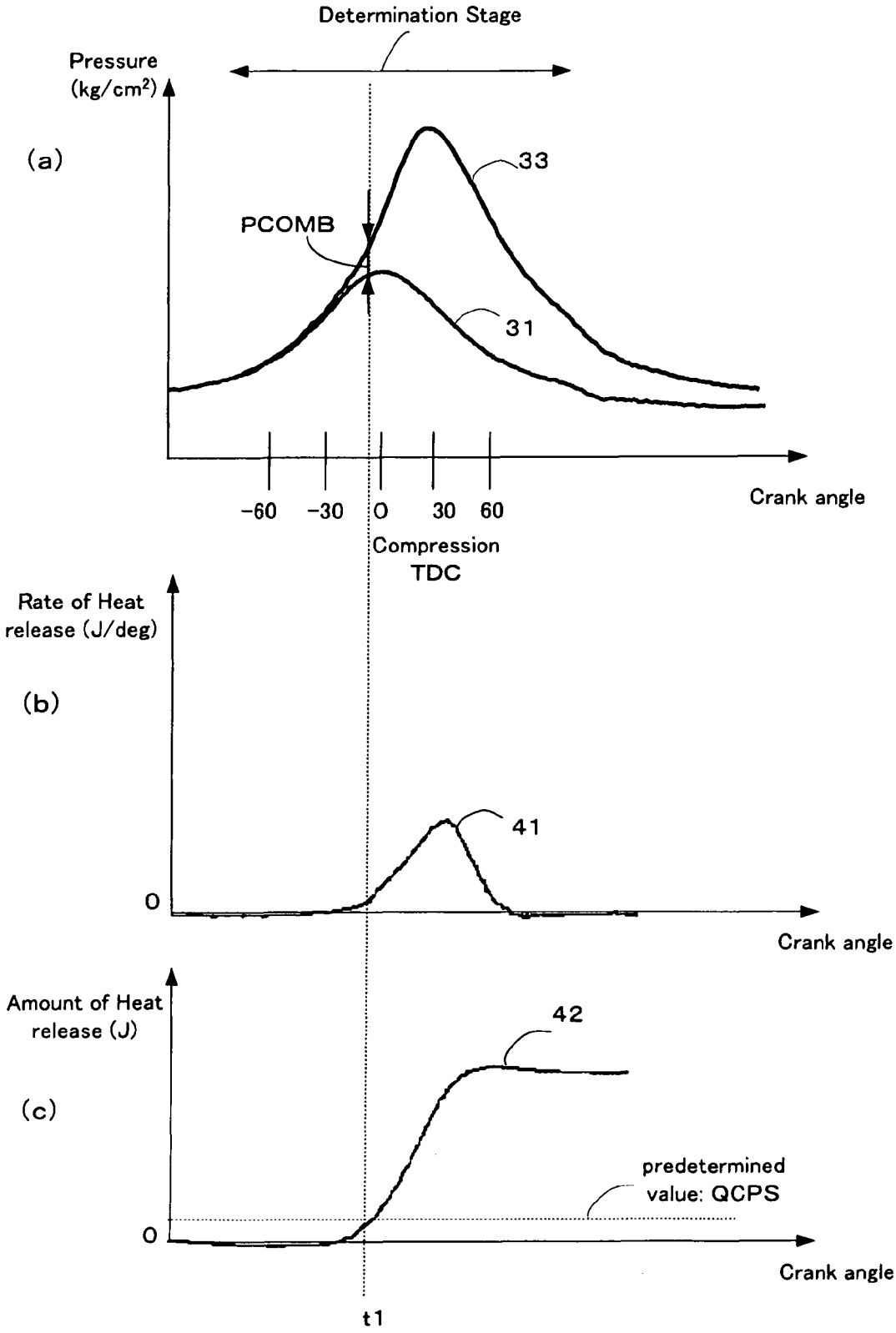
FIG. 3 is a diagram for showing a manner for determining a firing timing in accordance with one embodiment of the present invention.

In an example shown in FIG. 3(*a*), because the pressure difference PCOMB exceeds the determination value DP at time t1 (the heat release time point), the time t1 can be determined as a firing timing. One object of the present invention is to provide a technique for identifying, with a higher resolution, the time point at which the pressure difference exceeds the determination value. This technique will be described in detail later.

On the other hand, FIG. 3(*b*) shows a behavior 41 of a heat release rate dQ/dθ of heat generated by the combustion and FIG. 3(*c*) shows a behavior 42 of the heat release amount Q (which is an integrated value of the heat release rate). According to a second embodiment, because the firing timing can be determined based on the heat release time point as described above, the heat release amount Q is monitored over the period of the determination stage. A time point t1 at which the heat release amount Q exceeds a predetermined value QCPS is determined as a firing timing. Similarly, in this embodiment, one object of the present invention is to provide a technique for identifying, with a higher resolution, the time point at which the heat release amount exceeds the predetermined value. This technique will be also described in detail later.

Figure 4:
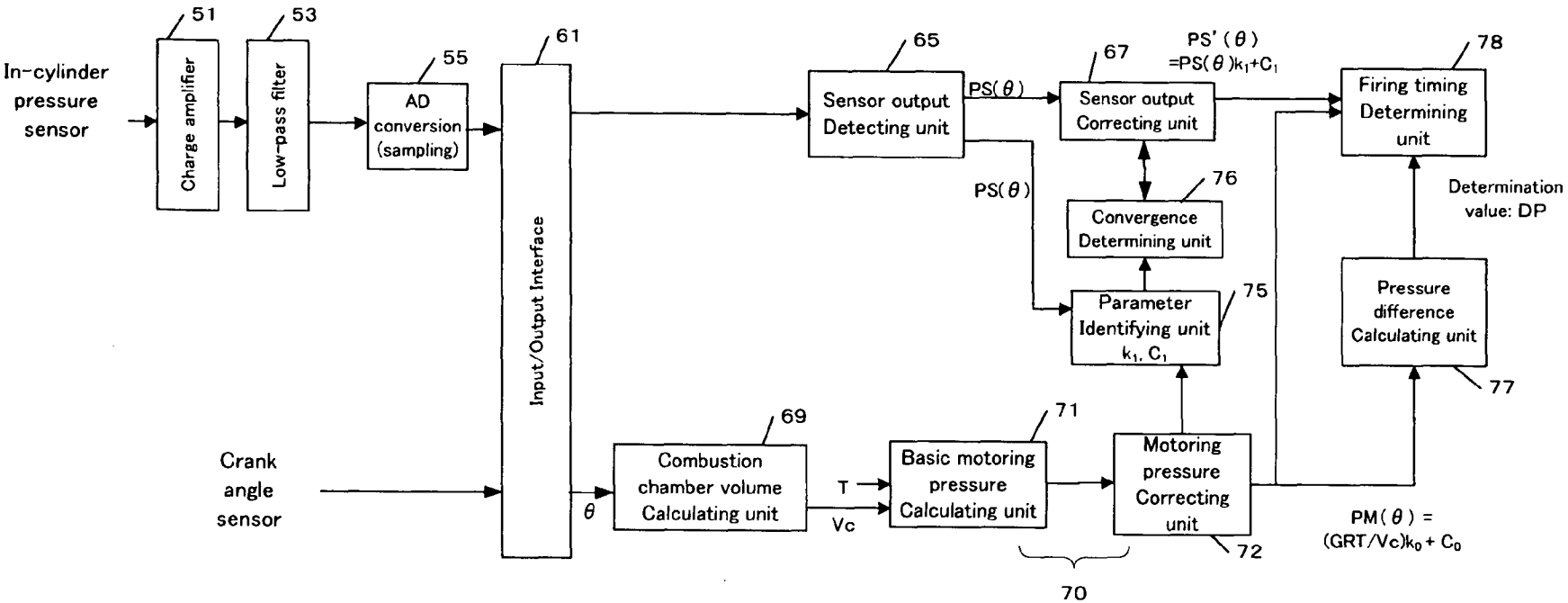
FIG. 4 is a functional block diagram of a control apparatus in accordance with one embodiment of the present invention.

FIG. 4 is a block diagram showing an overall structure of a control apparatus in accordance with one embodiment of the present invention. Each functional block is implemented in the ECU 1. This structure is based on the first embodiment for determining the firing timing that has been described above referring to FIG. 3(*a*).

An electric signal corresponding to the in-cylinder pressure (an in-cylinder pressure signal) that is output from the in-cylinder pressure sensor 17 is converted to a voltage signal by a charge amplifier 51. A low-pass filter 53 is applied to the converted voltage signal. An A/D converter 55 samples the in-cylinder signal with a predetermined frequency (for example, 50 kHz) over a predetermined period including the identification stage and the determination stage. The sample values obtained through the sampling process are stored in the memory of the ECU 1 via an I/O interface 61. Preferably, these sample values are directly stored in the memory, not through the CPU, by using the DMA (direct memory access).

In addition, although not illustrated in the drawings, other data (such as intake air amount, intake air temperature, engine rotational speed and so on) to be used in the identification process and the firing determination process are also measured and stored in the memory at every predetermined crank angle over the predetermined period including the identification stage and the determination stage.

In this embodiment, the identification process and the firing determination process, which will be described below, are performed by using such stored measurement values (such as the in-cylinder pressure values) after the above-described predetermined period during which the measurement values are stored has elapsed. For example, the identification process and the firing determination process are performed in an exhaust stroke.

A sensor output detecting unit 65 reads out the in-cylinder pressure sample values that have been measured in the predetermined period, calculates the in-cylinder pressure for every desired crank angle (for example, every one degree) by an interpolation calculation based on the in-cylinder pressure sample values, and then delivers the calculated in-cylinder pressure to a parameter identifying unit 75 and a sensor output correcting unit 67. A method of the interpolation calculation will be described later. Thus, the sensor output detecting unit 65 outputs the in-cylinder pressure actual measurement value PS corresponding to a crank angle θ.

The sensor output correcting unit 67 corrects the actual measurement value PS(θ) by using the correction parameters k1 and C1 in accordance with the above-described equation to calculate the corrected in-cylinder pressure PS'(θ).

On the other hand, a combustion chamber volume calculating unit 69 calculates a volume Vc of the combustion chamber of the cylinder associated with the crank angle θ in accordance with the equation (1) and the equation (2).

$$m=r\{(1-\cos\theta)+\lambda-\sin\sqrt{\lambda^2-\sin^2\theta}\} \quad (1)$$

$$V_c=V_{dead}+A_{pstn}\times m \quad (2)$$

Figure 5:
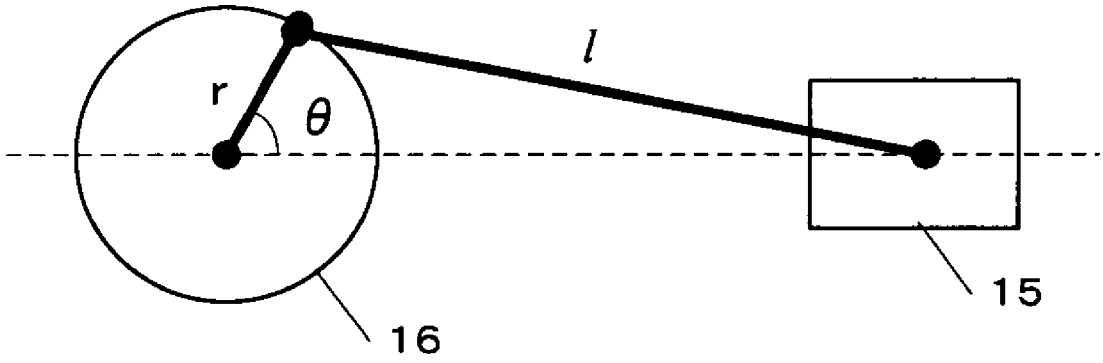
FIG. 5 schematically shows a method for calculating a piston position.

In the equation (1) and equation (2), "m" indicates a displacement of the piston 15 from the top dead center. The displacement is calculated from a relation shown in FIG. 5. Assuming that "r" represents a radius of the crankshaft 16 and "1" represents a length of a connecting rod, λ in the equation (1) is calculated by "λ=1/r". "Vdead" represents a combustion chamber volume when the piston 15 is positioned at the top dead center and "Apstn" represents a cross-sectional area of the piston 15.

Generally, it is known that a state equation for a combustion chamber is expressed as shown by the equation (3).

$$PM(\theta)=(GRT/V_c)\times k+C \quad (3)$$

In the equation (3), "G" indicates an amount of air that is taken into the cylinder. The intake air amount is detected by the airflow meter 8 (FIG. 1) or it is determined based on the engine rotational speed NE and the intake air pressure PB (which can be detected by the CRK sensor and the PB sensor of FIG. 1 respectively). "R" represents the gas constant and "T" represents an intake air temperature that is obtained, for example, from the intake air temperature sensor 11 (FIG. 1), or based on the operating condition of the engine such as an engine water temperature (which can be detected by the TW sensor 18 of FIG. 1). "k" is the correction coefficient and "C" is the correction term.

In one embodiment of the present invention, the pressure of the combustion chamber is actually measured in advance by using a crystal piezoelectric type of sensor that is not influenced by temperature change or the like at the place where the sensor is attached. By matching the actual pressure values to the equation (3), the value $k_0$ for k and the value $C_0$ for C are obtained in advance. Then, the motoring pressure is estimated by using the equation (4) that is obtained by substituting the values $k_0$ and $C_0$ into the equation (3).

$$PM(\theta)=(GRT/V_c)\times k_0+C_0 \quad (4)$$

A motoring pressure estimating unit 70 includes a basic motoring pressure calculating unit 71 and a motoring pressure correcting unit 72. The basic motoring pressure calculating unit 71 calculates a basic motoring pressure GRT/Vc that is a basic term in the equation (4). The motoring pressure correcting unit 72 corrects the basic motoring pressure by using the parameters $k_0$ and $C_0$ which are obtained in advance as described above. These parameters $k_0$ and $C_0$ may be prepared in advance as a table that can be searched based on parameters indicating engine load conditions such as the engine rotational speed or the intake air amount detected by the airflow meter 8.

A parameter identifying unit 75 identifies the correction parameters k1 and C1 through the least squares method, which is known, to minimize a difference (PM−PS') between the motoring pressure value PM calculated by the motoring pressure estimating unit 70 using the data (the intake air amount G and the intake air temperature T) measured in the period of the identification stage and the corrected internal cylinder pressure PS' that is generated by the sensor output correcting unit 67 based on the in-cylinder pressure measurement value PS in the same period of the identification stage. As described above referring to FIG. 2, the corrected in-cylinder pressure PS' should converge to the motoring pressure PM in the period of the identification stage. Therefore, the correction parameters are identified so that the difference between the pressures PS' and PM is minimized.

As described above, the corrected in-cylinder pressures PS' and the motoring pressures PM are calculated at every predetermined crank angle. Therefore, the identification process obtains k1 and C1 through the known least squares method so that a difference between the estimated motoring pressure value PM(θ) corresponding to a crank angle and the corrected internal cylinder pressure PS'=PS(θ)k1+C1 corresponding to the same crank angle is minimized, more specifically, so that a square of the difference, that is $(PM(\theta)-PS(\theta)k1-C1)^2$, is minimized.

By expressing discrete values of the PM with y(i) and discrete values of the in-cylinder measurement value PS obtained from the sensor output detecting unit 65 with x(i), the following expressions are obtained: $Y(i)^T=[y(0), y(1), \ldots, y(n)]$ and $X(i)^T=[x(0), x(1), \ldots, x(n)]$. A sum of squares of the discrete values of the error (difference) is expressed as shown by the equation (5). A value of "n" represents the number of the data that is output by the sensor output detecting unit 65 and used in the identification process.

$$\begin{aligned} F &= \sum[(k_1x(i)+C_1)-y(i)]^2 = \sum[y(i)-(k_1x(i)+C_1)]^2 \\ &= \sum[y(i)^2-2y(i)\times(k_1x(i)+C_1)+(k_1x(i)+C_1)^2] \end{aligned} \quad (5)$$

k1 and C1 for minimizing the value of F are determined as the values of k1 and C1 when a partial differential with respect to each of k1 and C1 for F(k1, C1) becomes zero, which is shown by the equation (6) and equation (7).

$$\partial F/\partial k1=\Sigma[-2y(i)x(i)+2k_1x(i)^2+2C_1x(i)]=0 \quad (6)$$

$$\Sigma y(i)=k_1\Sigma x(i)+C_1\times n \quad (7)$$

By simplifying the right sides of these equations, the equation (6') and equation (7') are obtained.

$$\Sigma y(i)x(i)=k_1\Sigma x(i)^2+C_1\Sigma x(i) \quad (6')$$

$$\Sigma y(i)=k_1\Sigma x(i)+C_1\times n \quad (7')$$

By expressing these equations by a matrix, the equation (8) is obtained.

$$= \begin{bmatrix} \sum x(i)^2 & \sum x(i) \\ \sum x(i) & n \end{bmatrix} \begin{bmatrix} \sum y(i)x(i) \\ \sum y(i) \end{bmatrix} \begin{bmatrix} k_1 \\ C_i \end{bmatrix} \tag{8}$$

Furthermore, the equation (8) can be transformed into the equation (9) by using an inverse matrix.

$$\begin{bmatrix} k_1 \\ C_1 \end{bmatrix} = \begin{bmatrix} \sum x(i)^2 & \sum x(i) \\ \sum x(i) & n \end{bmatrix}^{-1} \begin{bmatrix} \sum y(i)x(i) \\ \sum y(i) \end{bmatrix} \tag{9}$$

The inverse matrix in the right side is expressed as shown by the equation (10).

$$\begin{bmatrix} \sum x(i)^2 & \sum x(i) \\ \sum x(i) & n \end{bmatrix}^{-1} = \frac{1}{DET} \begin{bmatrix} n & -\sum x(i) \\ -\sum x(i) & \sum x(i)^2 \end{bmatrix} \tag{10}$$

$$DET = \sum x(i)^2 \times n - \sum x(i) \times \sum x(i)$$

(where, DET≠0)

A convergence determining unit 76 evaluates the parameters k1 and C1 calculated by the parameter identifying unit 75. More specifically, the convergence determining unit 76 determines whether the correction of the parameters enables the corrected in-cylinder pressure PS' to converge to the motoring pressure PM by, for example, examining the standard deviation of the difference between both the pressures.

If the degree of the convergence is within a tolerance as a result of the determination, the current parameters k1 and C1 are updated with the calculated values of the parameters k1 and C1. If the degree of the convergence is out of tolerance, the update of the parameters is not performed and the current parameters k1 and C1 are used in the below-described processes for determining the firing timing.

The sensor output correcting unit 67 uses the parameters k1 and C1 to calculate the corrected in-cylinder pressure PS' according to the above-described correction equation based on the in-cylinder pressure measurement value PS measured in the period of the determination stage as described above.

A pressure difference calculating unit 77 estimates, from the motoring pressure at the compression TDC, a pressure difference between the corrected in-cylinder pressure PS' and the motoring pressure PM at the heat release time point and outputs the estimated pressure difference as a determination value DP to be used for determining the firing timing. More specifically, the motoring pressure PM at the compression TDC is calculated in accordance with the equation (4). The motoring pressure PM×a (%) is calculated as the determination value DP. "a" can be established in advance through simulations or the like.

A firing timing determining unit 78 determines a pressure difference PCOMB between the corrected in-cylinder pressure PS' calculated by the sensor output correcting unit 67 based on the in-cylinder measurement value in the period of the determination stage and the motoring pressure PM calculated by the motoring pressure estimating unit 70 using the data measured in the period of that determination stage. Similarly to the identification process, the corrected in-cylinder pressure PS' and the motoring pressure PM are calculated at every predetermined crank angle. Thus, the pressure difference PCOMB is calculated based on the corrected in-cylinder pressure PS' and the motoring pressure PM that are associated with the same crank angle.

In the determination stage, when the firing timing determining unit 78 detects that the pressure difference PCOMB has exceeded the determination value DP, the unit 78 utilizes an interpolation calculation to identify a time point at which the pressure difference has exceeded the determination value. The identified time point is determined as a firing timing. Because the determination value DP indicates a pressure difference at the heat release time point (that is, a pressure difference when the firing has occurred), the firing timing can be determined by identifying the time at which the pressure difference PCOMB has exceeded the determination value DP.

Figure 6:
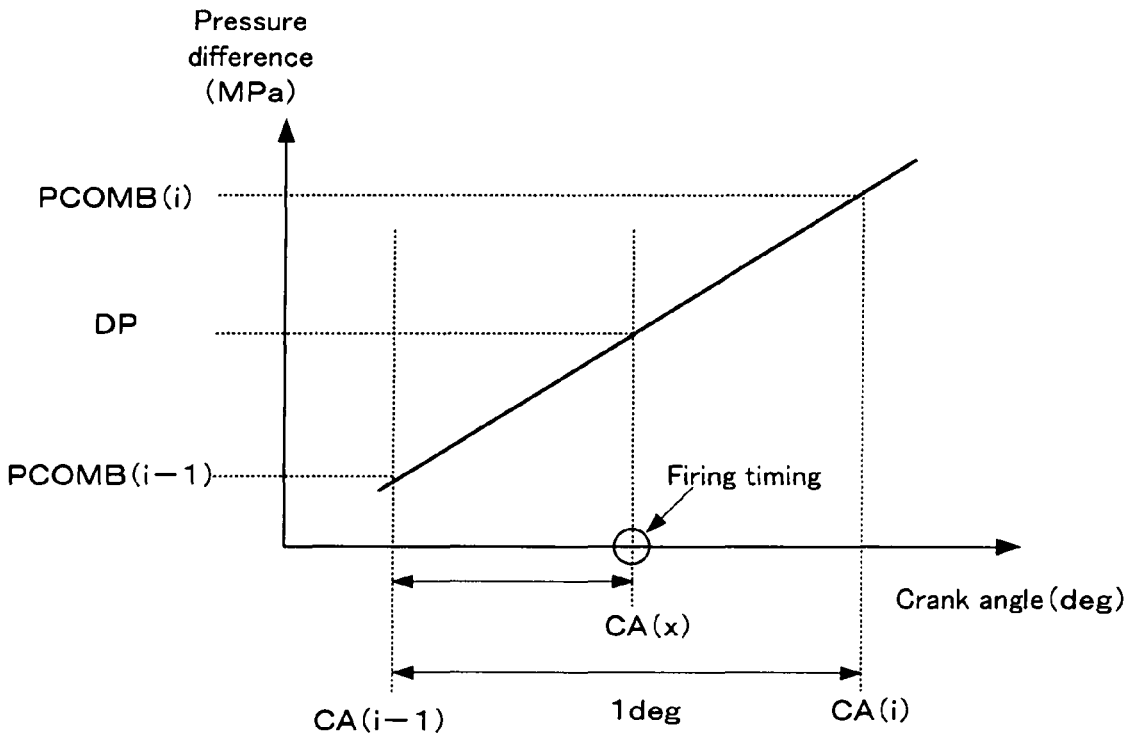
FIG. 6 schematically shows an interpolation calculation for calculating a firing timing with a finer resolution in accordance with one embodiment of the present invention.

Now, referring to FIG. 6, the interpolation calculation will be described. A first crank angle CA(i), shown in FIG. 6, is a crank angle at which the firing timing determining unit 78 detects that the pressure difference PCOMB has exceeded the determination value DP. This fact indicates that the pressure difference PCOMB has exceeded the determination value DP between the first crank angle and a second crank angle CA(i−1) that is previous to the first crank angle. Here, a difference between the first crank angle CA(i) and the second crank angle CA(i−1) corresponds to a crank angle interval at which every in-cylinder pressure value is calculated by the interpolation calculation of the sensor output detecting unit 65. For example, when the in-cylinder pressure for every one-degree crank angle is calculated by the sensor output detecting unit 65, the difference between the first crank angle CA(i) and the second crank angle CA(i−1) is one degree. The pressure difference corresponding to the first crank angle CA(i) is represented by PCOMB(i) and the pressure difference corresponding to the second crank angle CA(i−1) is represented by PCOMB(i−1).

The purpose of the interpolation calculation is to calculate a crank angle CA(x) at which the pressure difference PCOMB reaches the determination value DP. As clearly seen in FIG. 6, the crank angle CA(x) can be calculated according to the equation (11). Thus, the firing timing determining unit 78 calculates the time point CA(x) and determines the calculated time point CA(x) as the firing timing.

$$CA(x) = \frac{(DP - PCOMB(i-1))}{PCOMB(i) - )PCOMB(i-1)} \times 1(deg) + CA(i-1) \tag{11}$$

Thus, the firing timing can be identified with a finer resolution than the resolution with which the in-cylinder pressure is calculated. When the in-cylinder pressure is calculated, for example, with a resolution of one-degree crank angle, the firing timing can be identified with a finer resolution than one degree of crank angle.

Alternatively, the resolution of the in-cylinder pressure calculated by the sensor output detecting unit 65 is not necessarily limited to one degree of crank angle. For example, in a case where the resolution is two degrees of crank angle, 1(deg) in the equation (11) is replaced with 2(deg).

If the firing timing thus determined is earlier than a predetermined value, the firing timing determining unit 78 preferably prohibits an update operation for the firing timing because an error may be contained in the determined firing timing. In this case, the previous value that has been determined for the firing timing is used in the subsequent processes that use the firing timing. In one embodiment, if the firing timing determining unit 78 cannot identify a time point to be determined as the firing timing over the period of the determination stage, the unit 78 can determine that a misfire has occurred. Thus, presence/absence of a misfire can be determined in the firing timing determination process.

Now, referring to FIG. 7 through FIG. 14, a firing timing determination process in accordance with one embodiment of the present invention will be more specifically described.

Figure 7:
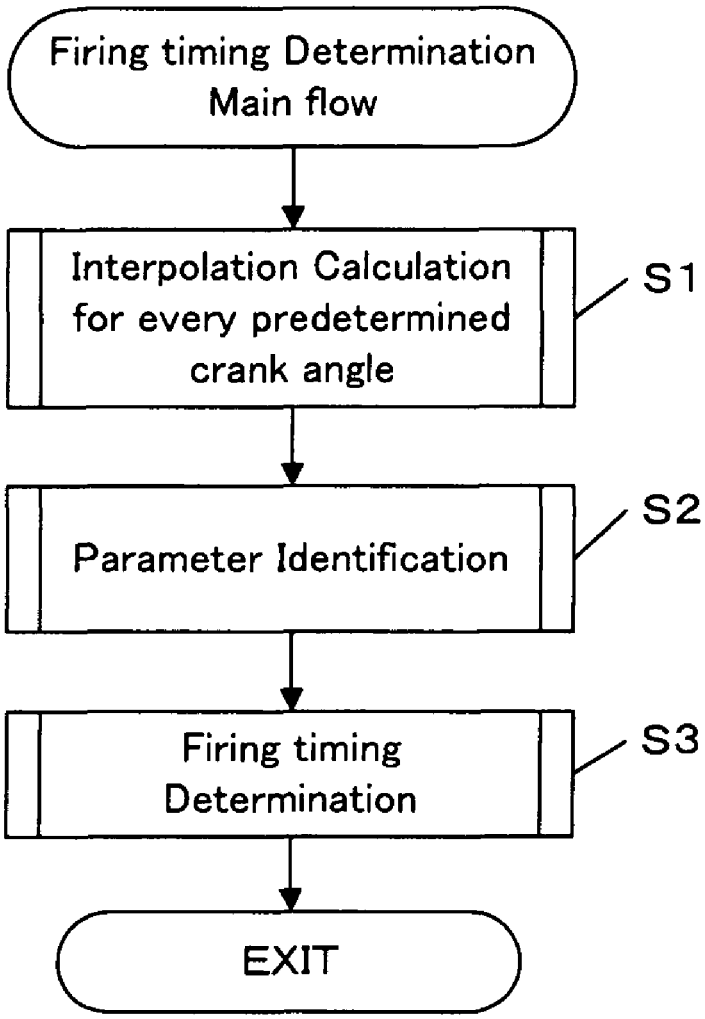
FIG. 7 shows a flowchart of a main process for determining a firing timing in accordance with one embodiment of the present invention.

FIG. 7 shows a main flow of the firing timing determination process that is performed, for example, during an exhaust stroke in each combustion cycle. This process is executed by the CPU of the ECU 1, more specifically, by the control apparatus shown in FIG. 4.

In step S1, an interpolation calculation (FIG. 8) for calculating the in-cylinder pressure for every predetermined crank angle is performed based on the in-cylinder pressure sample value acquired over a predetermined period including the identification stage and the determination stage. In step S2, an identification process (FIG. 11) for the parameters k1 and C1 is performed. In step S3, a firing timing determination process (FIG. 13, FIG. 14) is performed.

Figure 8:
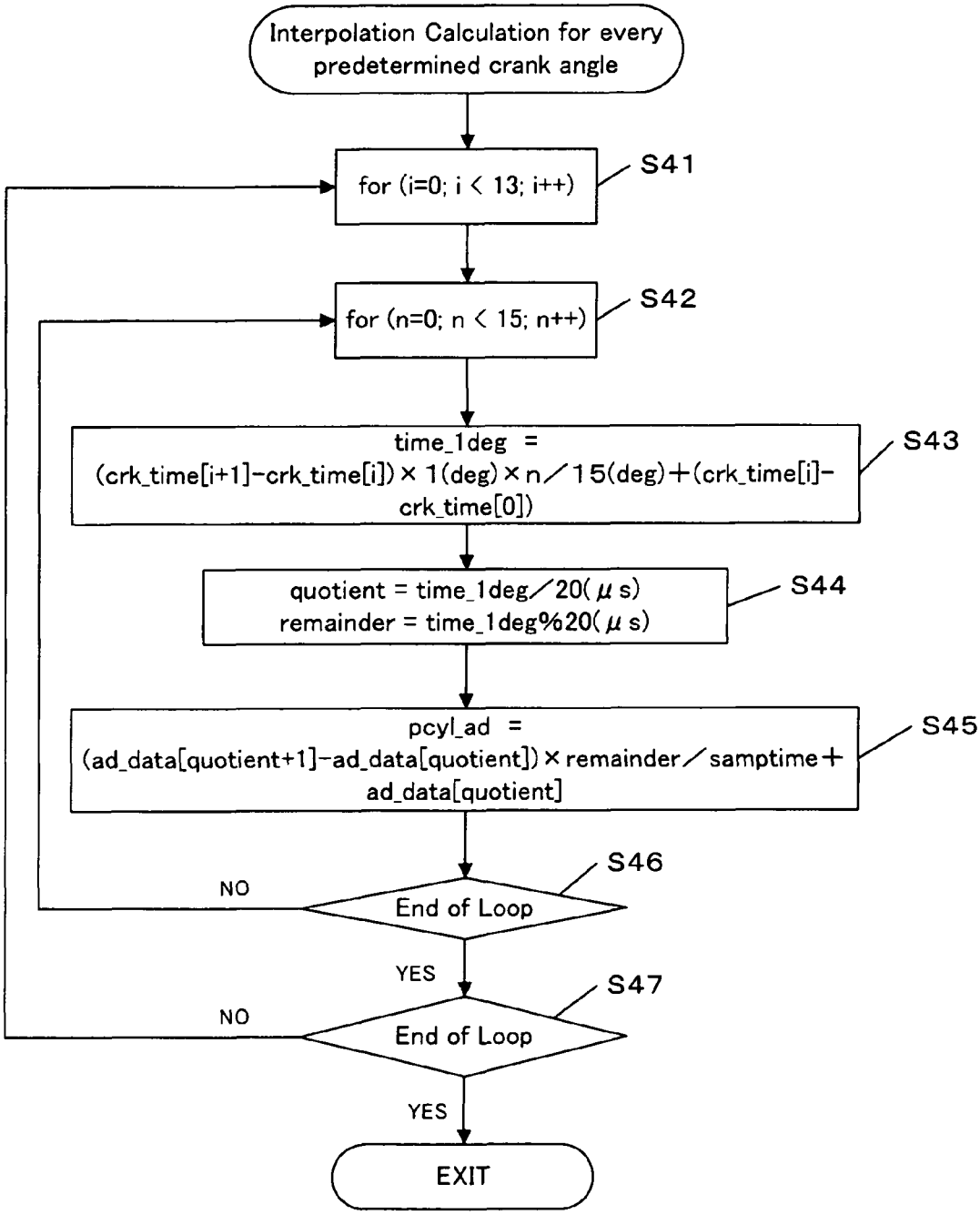
FIG. 8 is a flowchart of an interpolation calculation process for calculating an in-cylinder pressure for every predetermined crank angle in accordance with one embodiment of the present invention.

Referring to FIG. 8, the interpolation calculation process, which is to be performed in step S1 of FIG. 7, for calculating the in-cylinder pressure for every predetermined crank angle (every one degree in this example) is shown.

Prior to describing the interpolation process, the sampling process will be described. In this embodiment, as described above, the output of the in-cylinder pressure sensor 17 is sampled over the predetermined period including the identification stage and the determination stage with a predetermined frequency by the A/D converter 55 and the sample values thus obtained are sequentially stored in a predetermined area ad_data[ ] of the memory. In this embodiment, because the sampling frequency is 50 kHz, the sampling interval is 20 microseconds.

In addition, during the AD conversion, the time of the falling edge of the crank pulse (alternatively, the rising edge may be used) is obtained from the crank angle sensor 19 and stored in a predetermined area crk_time[ ] of the memory. In this embodiment, the crank pulse is issued at every 15 degrees of crank angle. Therefore, for example, when the period of the AD conversion is 195 degrees of crank angle (from 87.5 degrees before the compression TDC to 107.5 degrees after the compression TDC), the edge times of 13 crank pulses are stored.

The process shown in FIG. 8 is performed upon the sample values of the in-cylinder pressure that are stored in the memory over the predetermined period. Through this process, the in-cylinder pressure value for one-degree crank angle is calculated by using the interpolation calculation.

Step S41 shows that the number of times of repetition of a loop is the number of crank pulses from crk_time [0] to crk_time [i] in the predetermined period. In this embodiment, because the predetermined period corresponds to 195 degrees of crank angle, the loop is performed 13 times (13=195/15). Step S42 shows that the number of times of repetition of a loop is the number of the in-cylinder pressure values to be calculated between the crank pulses. In this embodiment, because the crank pulse is issued at every 15 degrees and it is the purpose of the process to determine the in-cylinder pressure for every one-degree crank angle, the number of times of the repetition of the loop is 15 (=15/1).

Figure 9:
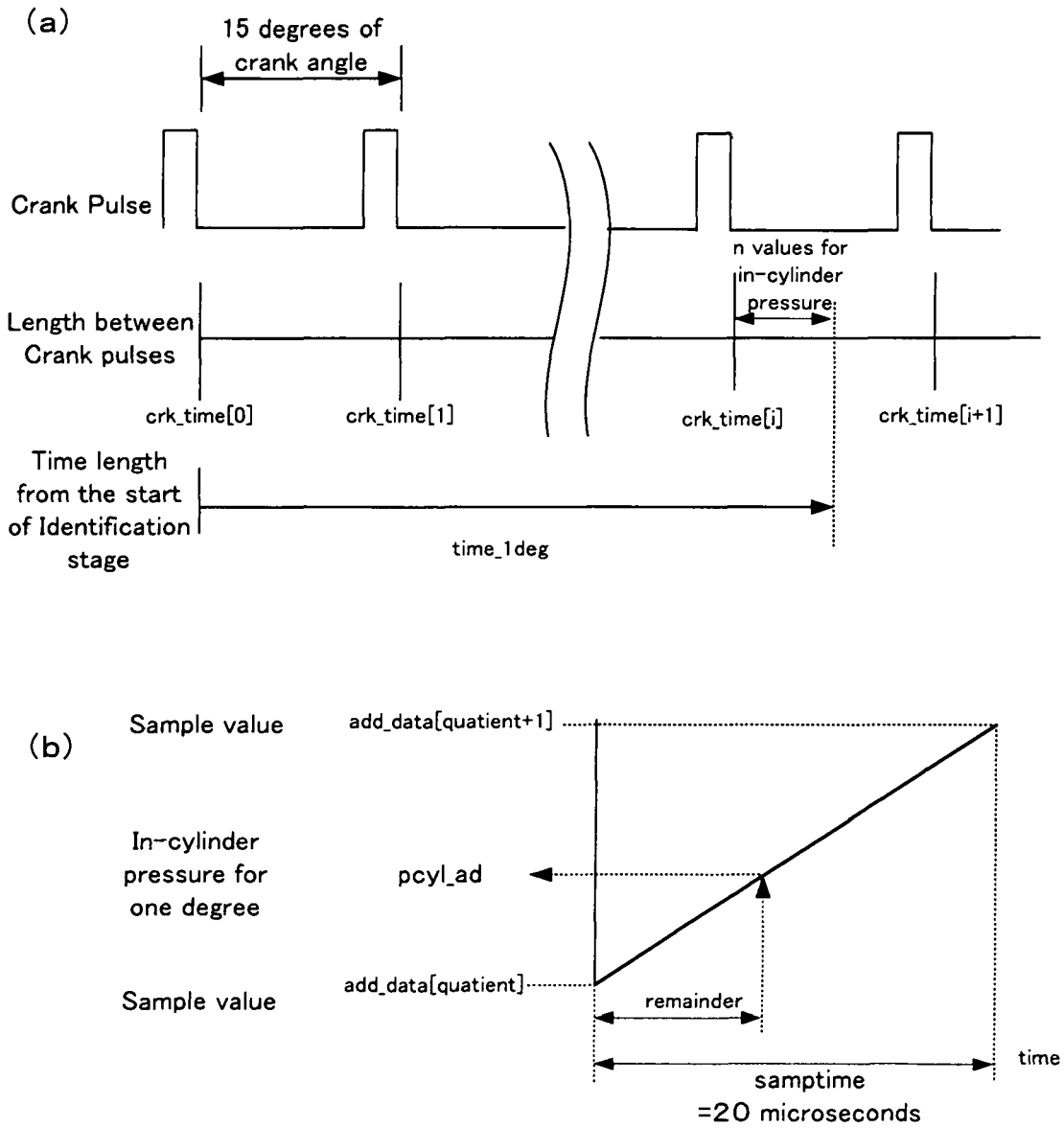
FIG. 9 is a diagram showing an interpolation calculation in accordance with one embodiment of the present invention.

In step S43, "crk_time(i+1)−crk_time(i)" represents a time length between the crank pulses. In this step, as shown in FIG. 9(*a*), a time length time__1deg from a start time of the identification stage to a time point corresponding to the n-th (n<15) in-cylinder pressure value calculated between the crank pulses is calculated according to the equation (12).

$$\text{time_1}deg=(crk_\text{time}[i+1]-crk_\text{time}[i])\times 1(deg)\times n/15(deg)+(crk_\text{time}[i]-crk_\text{time}[0]) \quad (12)$$

In step S44, the time length time__1deg is divided by 20 microseconds (which is the sampling interval). Its quotient is set to "quotient" and the remainder is set to "remainder". The calculated quotient identifies which sample value should be used.

In step S45, the in-cylinder pressure value for one degree of crank angle is calculated according to the interpolation calculation shown in the equation (13). If there is a remainder as shown in FIG. 9(*b*), the interpolation is performed between the sample value ad_data [quotient] and the sample value ad_data [quotient+1]. Here, "samptime" represents the sampling interval, which is 20 microseconds in this example. Through this interpolation, the in-cylinder pressure value pcyl_ad for one degree of crank angle is calculated. In a case where there is no remainder, the sample value ad_data [quotient] can be used unchanged as the in-cylinder pressure for one degree of crank angle.

$$pcyl_ad=(ad_\text{data}[\text{quotient}+1]-ad_\text{data}[\text{quotient}])\times \text{remainder}/\text{samptime}+ad_\text{data}[\text{quotient}] \quad (13)$$

Figure 10:
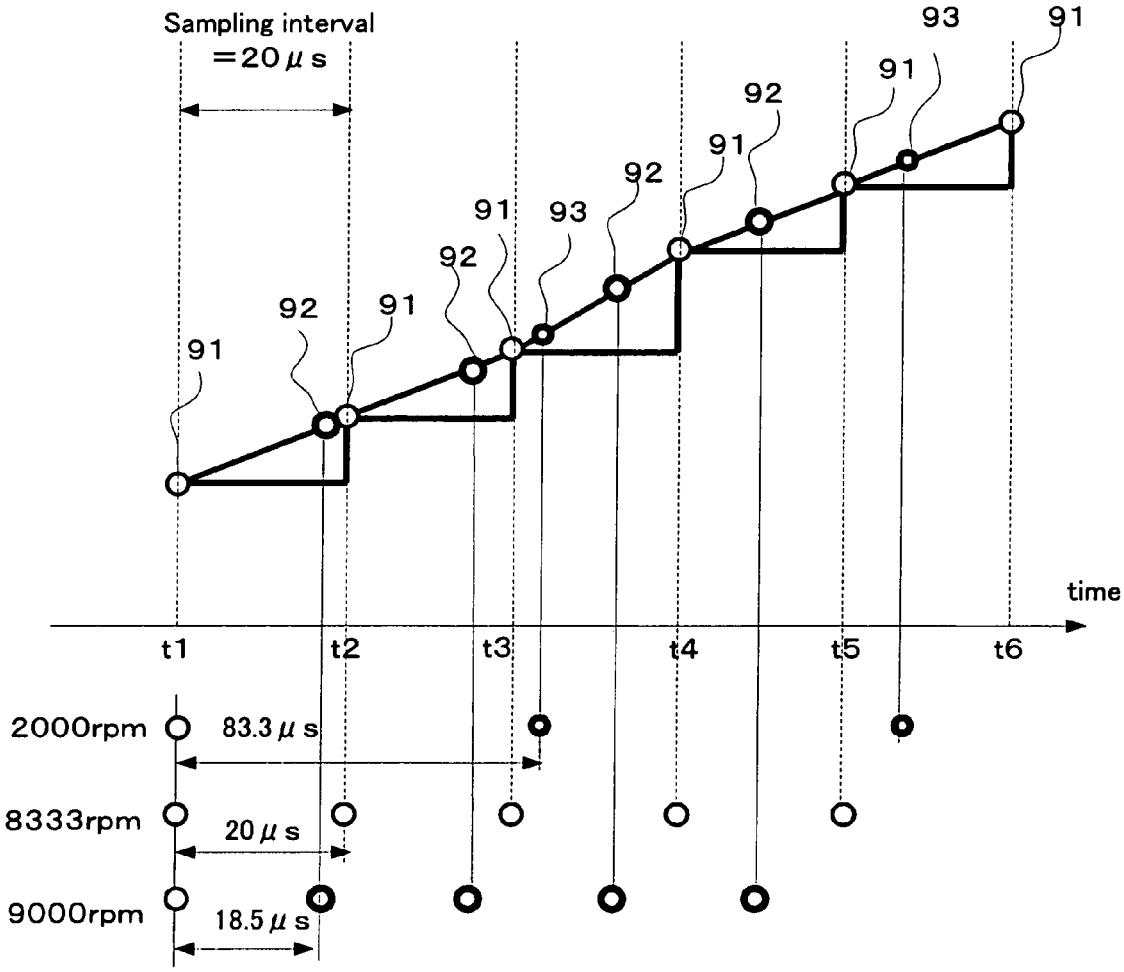
FIG. 10 is a diagram showing an interpolation calculation in accordance with one embodiment of the present invention.

Referring to FIG. 10, the sample values 91 which have been sampled at the time interval of 20 microseconds are shown. The time length per one degree of crank angle changes depending on the engine rotational speed. When the engine rotational speed is 8333 rpm, one degree is equivalent to 20 microseconds, which just corresponds to the sampling interval. Because the remainder becomes zero in step S44, the sample value 91 can be used as the in-cylinder pressure value for one degree of crank angle.

In a case of a lower rotational speed of 2000 rpm or a higher rotational speed of 9000 rpm, the time length corresponding to one degree is longer (83.3 microseconds) or shorter (18.5 microseconds). In such a case, the interpolation is performed. For example, in a case of 2000 rpm, the interpolation is performed between the sample value 91 at time t3 and the sample value 91 at time t4, so that a sample value 93 for one degree is calculated. For example, in a case of 9000 rpm, the interpolation is performed between the sample value 91 at time t1 and the sample value 91 at time t2, so that the sample value 92 for one degree is calculated.

Although the process of FIG. 8 is configured to perform the interpolation for every one degree of crank angle, the interpolation is not limited to this angle value. Any angle value may be applied to the interpolation calculation. For example, when the interpolation calculation is performed for every 3 degrees of crank angle, the value of 15 of step S42 needs to be changed to 5(=15/3) and step S43 needs to be changed to the following equation:

$$\text{time_3}deg=(crk_\text{time}[i+1]-crk_\text{time}[i])\times 3(deg)\times n/15+crk_\text{time}[i]-crk_\text{time}[0]$$

Then, time__3deg thus calculated is divided by 20 microseconds to obtain the quotient and the remainder and step S45 is processed to calculate the in-cylinder pressure Pcyl_ad for three degrees of crank angle.

Thus, the in-cylinder pressure value pcyl_ad for every predetermined crank angle over the predetermined period including the identification stage and the determination stage is calculated and stored in the memory by the sensor output detecting unit 65. This value is used as the in-cylinder pressure PS in the subsequent processes.

Now, advantages of the above-described sampling process and interpolation calculation will be described. Conventionally, measurement data such as an in-cylinder pressure or the like which are acquired by sensors are sampled in synchronization with a crank pulse and then a CPU obtains the sampled values to perform a certain calculation upon those values. When a system tries to obtain measurement data with a finer resolution, for example, at an interval of one degree of crank angle so as to improve the control accuracy, the system needs to increase the sampling frequency for sampling the measurement data at one-degree interval. In addition, the CPU needs to receive the sampled measurement data at one-degree interval so as to perform a calculation at the same interval. The CPU needs to interrupt processes being executed when the CPU receives the measurement data. Therefore, the load of the CPU may increase as the interval of the crank pulses is shorter.

In contrast, according to the above-described embodiment of the present invention, the sampling frequency does not need to be increased because the in-cylinder pressure for every desired crank angle (for example, every one degree) can be calculated through an interpolation calculation from the sample values of the measurement data that are acquired at a predetermined time interval. Furthermore, the crank pulses are used only for calculating a time length (crk_time(i+1)−crk_time(i)) of the crank pulse interval. Therefore, even when a finer crank angle interval (for example, one degree interval) is desired, an increase of the CPU load can be suppressed because the CPU does not need to receive the measurement data at such a fine crank angle interval for the calculation.

Furthermore, according to the present invention, the above-described predetermined period (that is, the period of 195 degrees in this example) for acquiring the data is separated from the calculation period (for, example, the exhaust stroke). Therefore, during the predetermined period, the sample values of the measurement data can be directly stored in the memory, not through the CPU, by using the direct memory access (DMA). Therefore, an unnecessary load for the CPU can be avoided. The CPU only needs to access the memory when the CPU performs the interpolation calculation.

Moreover, there are various waveform patterns of the crank pulse depending on the types of vehicles. For example, a portion where the time length of a pulse is, for example, double is provided in a waveform of a crank pulse for discriminating cylinders. Such a portion is called a "missing tooth". By detecting the crank pulse corresponding to such a missing tooth portion, the ECU 1 can identify a cylinder where a piston reaches the top dead center. In a case where a calculation process is performed in synchronization with the crank pulse, such a calculation process may be substantially skipped in response to the detection of the "missing tooth" portion that has a longer time interval. According to the above-described embodiment of the present invention, even when a missing tooth portion is detected, the in-cylinder pressure at a desired crank angle interval can be calculated by replacing 15(deg) of step S43 with a value corresponding to an interval of the missing tooth portion (for example, 30 deg). Thus, measurement data can be generated at a constant interval independently of the waveform pattern of the crank pulse.

Furthermore, according to this embodiment, because all the data measured in the above-described predetermined period is stored in the memory, the subsequent identification process and control process can arbitrarily select any amount of data in any period from the memory. For example, the processes can select the data depending on the contents of the process and/or depending on the engine operating condition.

Preferably, the sampling frequency (50 kHz in this embodiment) is established depending on an object to be detected. In this embodiment, in order to detect not only the firing timing but also the knocking, a frequency that is twice or more times the knocking frequency (about 13.5 kHz) is selected. The knocking can be detected in accordance with any known technique (for example, a technique described in Japanese Patent Application Publication No. 2006-183533) by using the in-cylinder pressure for every predetermined crank angle (for example, every one degree) that is calculated by the process of FIG. 8.

Figure 11:
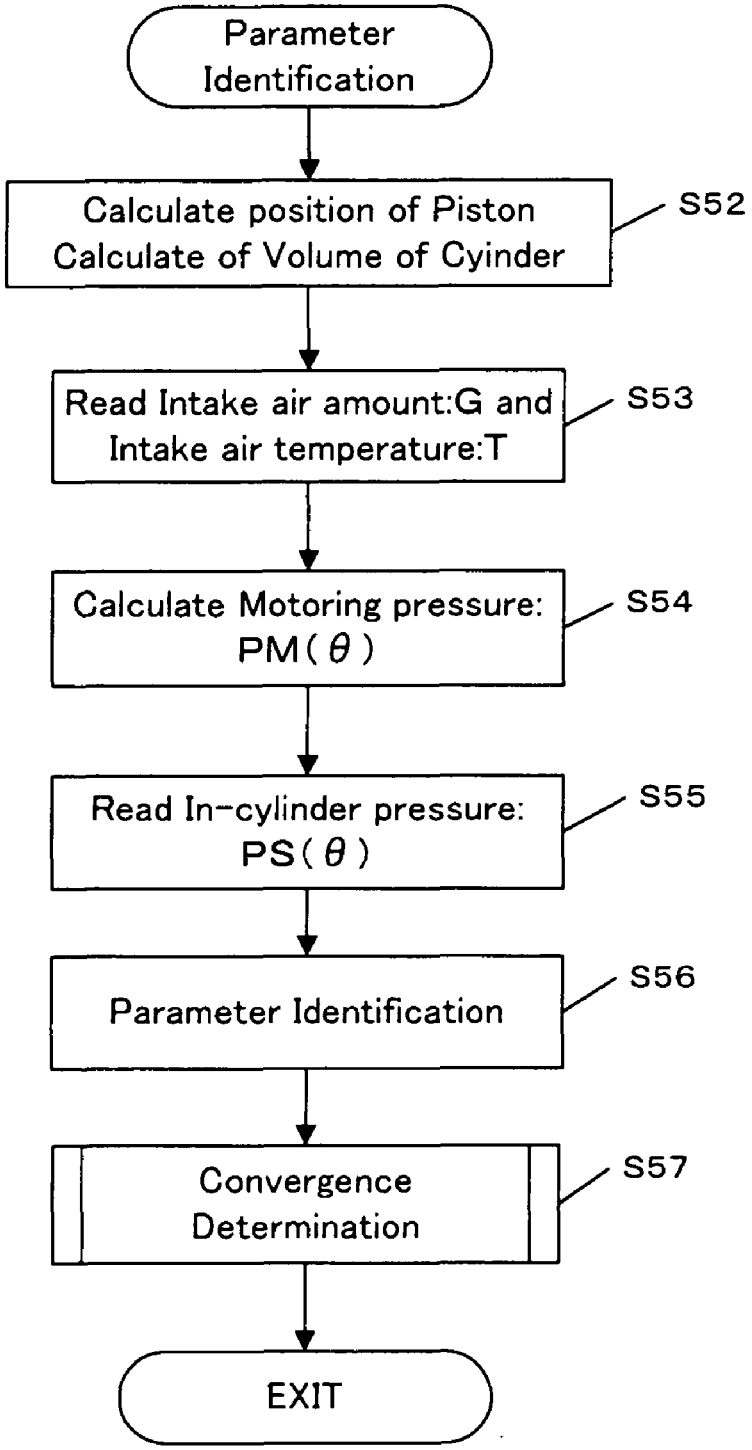
FIG. 11 is a flowchart of an identification process in accordance with one embodiment of the present invention.

FIG. 11 is a flowchart of the identification process performed in step S2 of FIG. 7. During the identification process, the in-cylinder pressure values in the period of the identification stage are selected among the in-cylinder pressure values for every predetermined crank angle (every one degree in this example) that have been calculated and stored in the memory by the process of FIG. 8. The period of the identification stage is predetermined. In this embodiment, this period has a length of 55 degrees from 75 to 20 degrees before the compression TDC. Therefore, when the predetermined crank angle is one degree, 55 in-cylinder pressure values are used. As described above, the other measurement values (such as intake air amount, intake air temperature, engine rotational speed and so on) have been acquired and stored in the memory at every predetermined crank angle (for example, at every 15 degrees) in the period of the identification stage. Calculation of the following equations is performed for each of the selected in-cylinder pressure values. Furthermore, measurement values corresponding to each in-cylinder pressure value are used. More specifically, the latest measurement values that have been already acquired at the time point (which can be identified by "time_1deg" of FIG. 9) corresponding to the in-cylinder pressure value are used.

In step S52, the position of the piston is calculated in accordance with the above-described equation (1) and the cylinder volume is calculated in accordance with the above-described equation (2). Further, in step S53, the detection value G of the airflow meter 8 and the detection value T of the intake air temperature sensor 11 are read from the memory. In step S54, the cylinder volume Vc, the intake air amount G and the intake air temperature T are used to calculate the motoring pressure PM(θ) in accordance with the equation (4).

In step S55, the in-cylinder pressure PS(θ) calculated in FIG. 8 is read. In step S56, the parameters $k_1$ and $C_1$ are identified in accordance with the equation (9). In step S57, a convergence determination process (FIG. 12) is performed.

Figure 12:
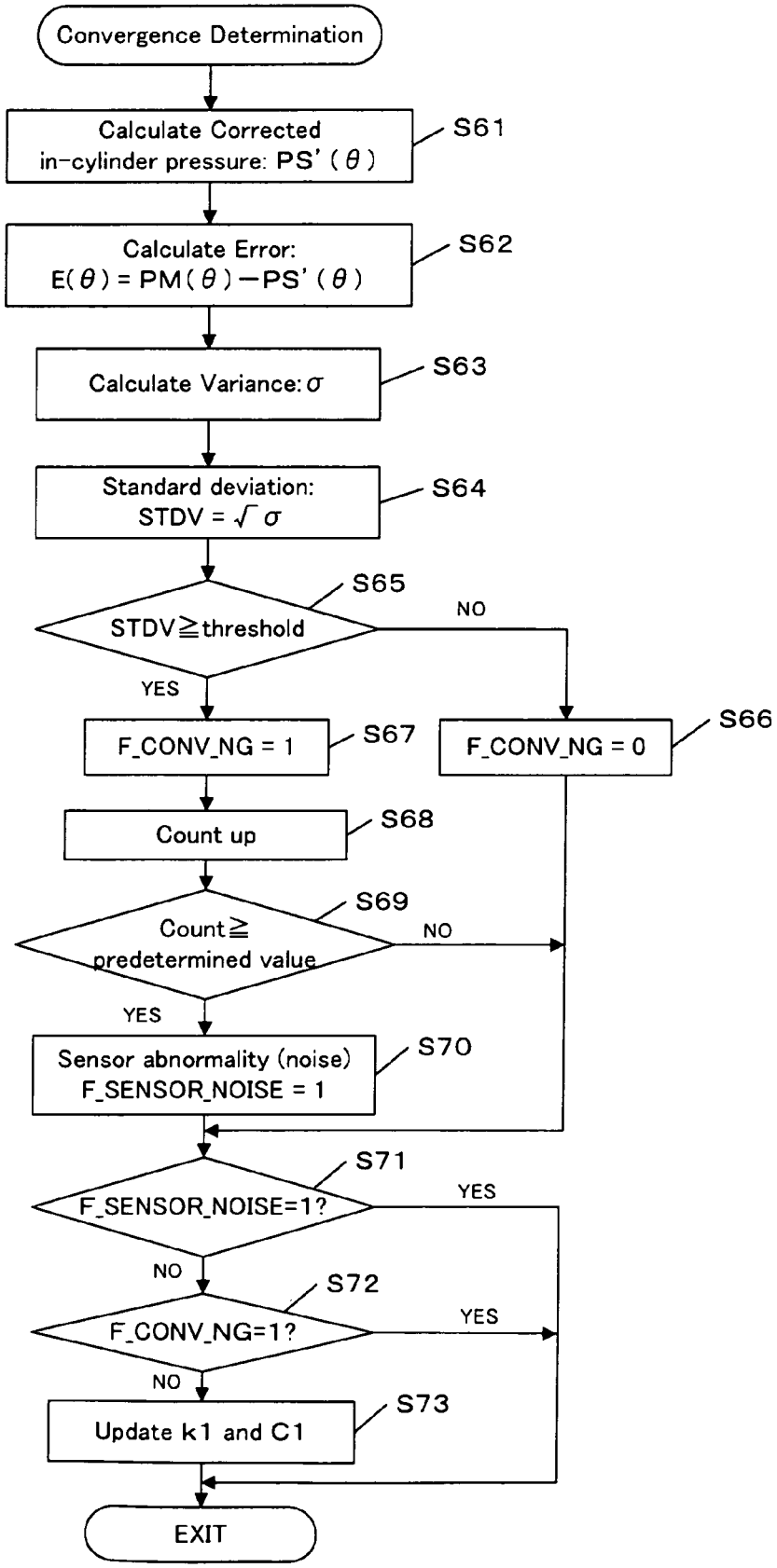
FIG. 12 is a flowchart of a convergence determination process in accordance with one embodiment of the present invention.

FIG. 12 shows the convergence determination process performed in step S57. In order to evaluate the validity of the parameters k1 and C1, this process determines whether or not the corrected in-cylinder pressure PS' corrected by the parameters k1 and C1 desirably converges to the motoring pressures PM.

In step S61, the in-cylinder pressure PS(θ) that has been used in the identification process is corrected according to the above-described correction equation using the identified parameters $k_1$ and $C_1$ to calculate the corrected in-cylinder pressures PS'(θ). In step S62, an error E(θ) (=PM(θ)−PS'(θ)) between the corrected in-cylinder pressure PS'(θ) and the motoring pressure PM(θ) calculated in step S54 of FIG. 11 is calculated. In step S63, a variance a for the error E is calculated in accordance with the equation (14). "n" in the equation (14) is the same as "n" shown in the equation (9), representing the number of the in-cylinder pressure values that have been used in the identification process.

$$\sigma = \frac{n\sum E(\theta)^2 - \sum E(\theta)\cdot\sum E(\theta)}{n(n-1)} \quad (14)$$

In step S64, the standard deviation STDV is calculated as a square root of the variance. In step S65, if the standard deviation STDV is smaller than a predetermined threshold value, it is determined that the error between the motoring pressure PM and the corrected in-cylinder pressure PS converges and a convergence flag F_CONV_NG is set to zero (S66).

In step S65, if the standard deviation STDV is equal to or larger than the predetermined threshold value, it is determined that the error does not converge. In this case, there is a probability that a failure has occurred. For example, there is a probability that a noise has occurred due to an abnormality in the in-cylinder pressure sensor or the calculation has overflowed. Accordingly, in step S67, the convergence flag F_CONV_NG is set to 1.

In step S68, the number of times that the convergence flag is set to 1 is counted up. In step S69, if the counted value exceeds a predetermined value (for example, 100), a flag F_SENSOR_NOISE indicating an abnormality in the in-cylinder pressure sensor is set to 1 (S70).

In step S71 and step S72, it is checked whether or not each value of the flags F_SENSOR_NOISE and F_CONV_NG is 1. If both the flag values are zero, the currently identified parameters k1 and C1 are accepted as appropriate parameters. Accordingly, in step S73, the values of the parameters that have been previously identified are updated with the values of the currently identified parameters. Then, the process is terminated. If one of the flag values is 1 in step S71 and step S72, the parameters k1 and C1 are not updated and the process is terminated.

Figure 13:
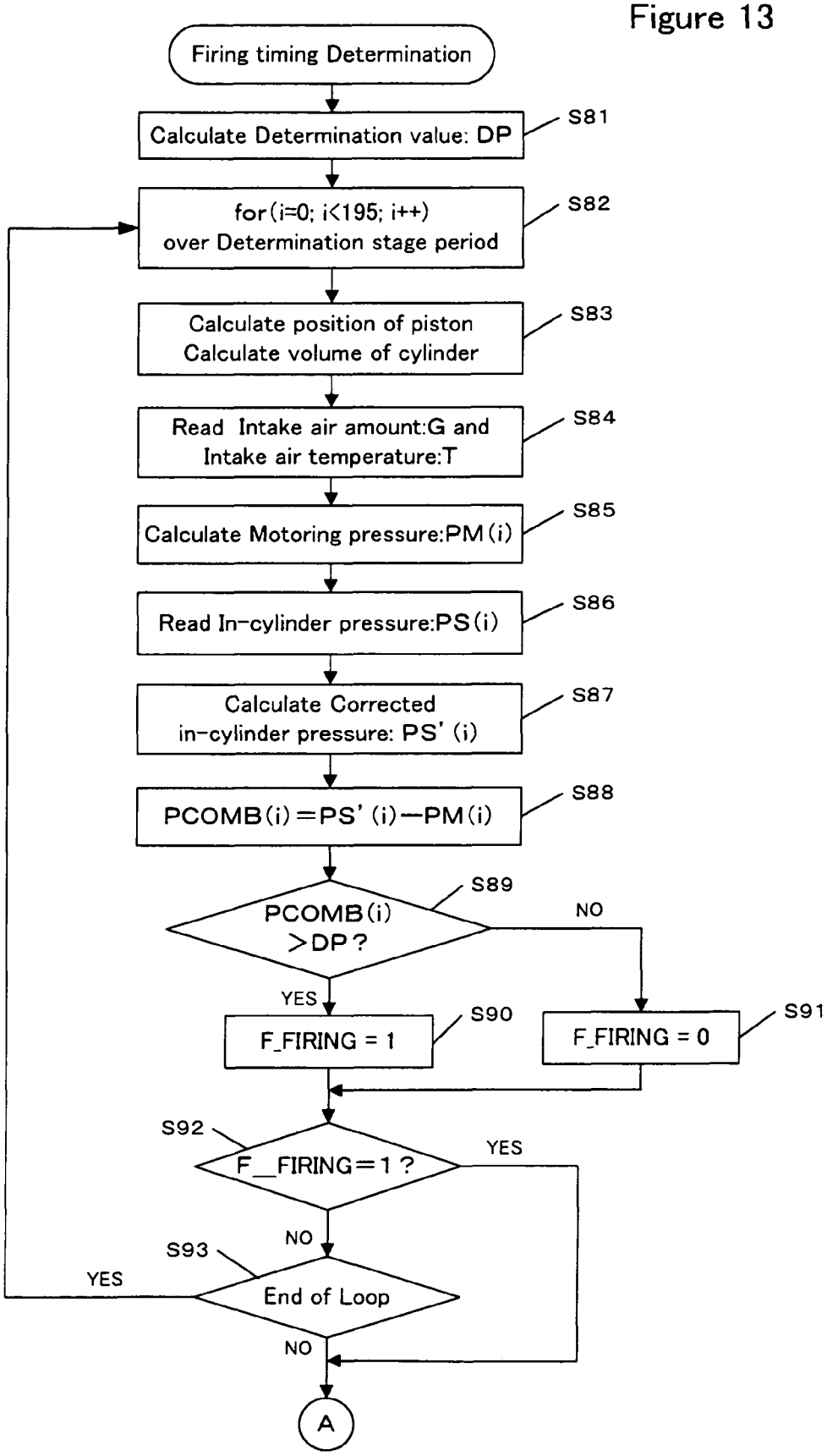
FIG. 13 is a flowchart of a firing timing determination process in accordance with one embodiment of the present invention.
Figure 14:
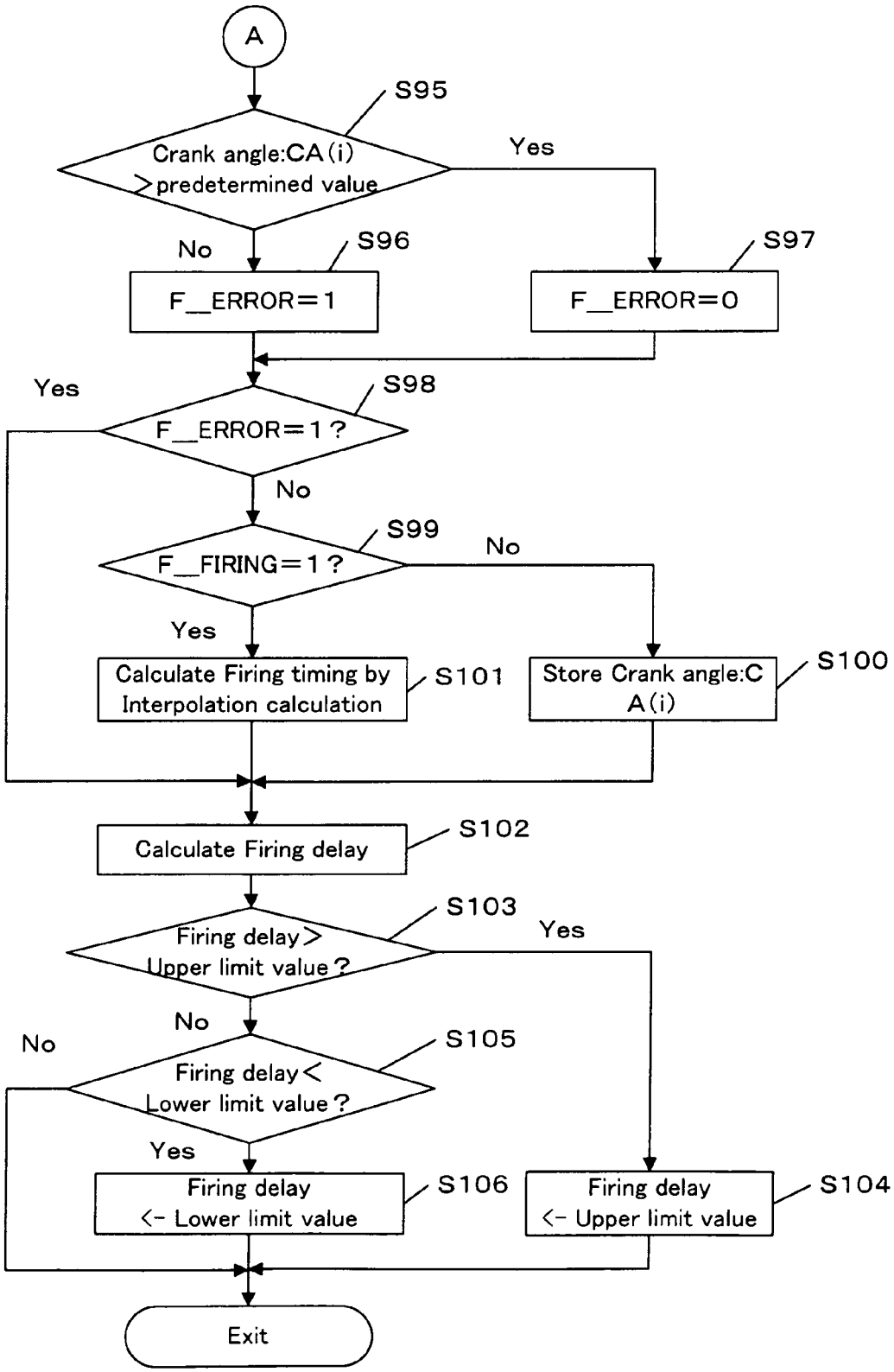
FIG. 14 is a flowchart of a firing timing determination process in accordance with one embodiment of the present invention.

FIG. 13 and FIG. 14 show the firing timing determination process performed in step S3 of FIG. 7. In step S81, the pressure difference DP at the heat release time point is calculated as the determination value as described above. In one embodiment, the motoring pressure PM at the compression TDC is calculated. More specifically, the piston position and the cylinder volume at the compression TDC are calculated in accordance with the equation (1) and equation (2). The intake air amount G and the intake air temperature T at that TDC are read in. Then, the motoring pressure PM is calculated according to the equation (4). The determination value DP is calculated by multiplying that motoring pressure PM by a predetermined rate (for example, 5%).

Among the in-cylinder pressure values for every predetermined crank angle (every one degree in this example) calculated and stored in the memory by the process of FIG. 8, the in-cylinder pressure values in the period of the determination stage to be used in the following steps are selected. As described above, the other measurement values (such as intake air amount, intake air temperature, engine rotational speed and so on) have been acquired and stored in the memory at a predetermined crank angle interval (for example, every 15 degrees) in the period of the determination stage. Calculation of the following equations is performed for each of the selected in-cylinder pressure values. Furthermore, measurement values corresponding to each in-cylinder pressure value are used. More specifically, the latest measurement values that have been already acquired at the time point (which can be identified by "time_1deg" of FIG. 9) corresponding to the in-cylinder pressure value are used.

The determination stage can be determined in advance. In this embodiment, the determination stage corresponds to the above-described AD conversion period (for example, a period of 195 degrees from 87.5 degrees before the compression TDC to 107.5 degrees after the compression TDC). Alternatively, in order to perform the firing timing determination at the most appropriate timing from the viewpoint of the engine operating condition, the period of the determination stage may be established in accordance with the engine operating condition. For example, because the firing of air-fuel mixture starts after the ignition timing, a predetermined time period from the ignition timing can be used as the determination stage. Furthermore, the period of the determination stage can be determined, for example, by referring to a predetermined map (which is stored in advance in the memory) based on the operating condition such as an ignition timing or the like.

Step S82 indicates that a loop is repeated the number of times corresponding to the number of the in-cylinder pressure values that have been calculated over the period of the determination stage by the process of FIG. 8. For example, if the determination stage is the above-described 195 degrees of crank angle, the loop is repeated 195 times (i=0 to 194) because the in-cylinder pressure values for one degree of crank angle are calculated in FIG. 8.

In step S83, the displacement m of the piston from the top dead center and the cylinder volume Vc are calculated in accordance with the equation (1) and equation (2). In step S84, the intake air amount G and the intake air temperature T are read from the memory.

In step S85, each motoring pressure value PM(i) is calculated according to the equation (4). In step S86, each in-cylinder pressure value PS(i) is read in. In step S87, each corrected in-cylinder pressure value PS'(i) is calculated in accordance with the above-described correction equation.

In step S88, the motoring pressure PM(i) calculated in step 85 is subtracted from the corresponding corrected in-cylinder pressure PS'(i) calculated in step S87 to determine a pressure difference PCOMB(i). In step S89, it is determined whether or not the pressure difference PCOMB(i) is larger than the determination value DP calculated in step S81. If it is larger, it is determined that the firing has occurred and a value of 1 is set in a flag F_FIRING (S90). If the decision of step S89 is No, a value of zero is set in the flag F_FIRING (S91).

If the value of 1 is set in the flag F_FIRING, the process exits from the loop that starts from step S82 (S92). If the value of 1 is set in the flag F_FIRING, the crank angle CA(i) at the time at which the loop is terminated indicates a crank angle at which the firing has started. On the other hand, if the flag F_FIRING has not been set to 1 over the period of the determination stage, the loop is terminated with the value of the flag being kept at zero. In this case, the crank angle CA(i) at the time at which the loop is terminated indicates a crank angle corresponding to the end point of the determination stage.

Then, the process proceeds to step S95 of FIG. 14, in which it is determined whether or not the crank angle CA(i) at the termination time of the loop is equal to or larger than a predetermined value. As described above, if the value of the flag F_FIRING is 1, the crank angle CA(i) indicates the crank angle of the firing occurrence. Therefore, the determination in step S95 is performed to determine whether or not the firing occurrence crank angle is too early (that is, in the left direction in FIG. 2). For example, if the firing occurrence crank angle CA(i) indicates that it is earlier than the ignition timing, the firing occurrence crank angle may contain an error. Therefore, if the firing occurrence angle CA(i) is equal to or smaller than the predetermined value, it is determined that the firing occurrence crank angle may contain an error and a value of 1 is set in a flag F_ERROR in step S96.

If the firing occurrence crank angle is larger than the predetermined value, a value of zero is set in the flag F_ERROR in step S97. On the other hand, if the value of the flag F_FIRING is zero, the crank angle CA(i) indicates a crank angle at the end point of the determination stage. Accordingly, the decision of step S95 is "Yes" and the flag F_ERROR is set to zero.

In step S98, the value of the flag F_ERROR is checked. If it is 1, the update of the firing timing is prohibited and then the process proceeds to step S102. Thus, the update of the firing timing with a value that may contain an error can be prevented.

In step S99, the value of the flag F_FIRING is checked. If it is zero, it indicates that a time point to be determined as the firing timing has not been found out during the determination stage. Accordingly, the crank angle CA(i) is stored in the memory in step S100. Thus, in a subsequent process after a completion of this firing timing determination process, the stored CA(i) may be checked. If CA(i) indicates a crank angle corresponding to the end point of the determination stage, it can be determined that a misfire has occurred.

If the value of the flag F_FIRING is 1 in step S99, the process proceeds to step S101, in which the pressure difference PCOMB(i) corresponding to the crank angle CA(i), the crank angle CA(i−1) that is previous by one predetermined crank angle interval to the crank angle CA(i), and the pressure difference PCOMB(i−1) corresponding to the crank angle CA(i−1) are used to calculate a firing timing CA(x) in accordance with the interpolation calculation equation (11) that has been described above referring to FIG. 6. Thus, with the resolution that is equal to or higher than the resolution (one degree in this example) of the calculation of the in-cylinder pressure of FIG. 8, the crank angle CA(x) at the time at which the pressure difference PCOMB exceeds the determination value DP can be identified as the firing timing.

Then, the process proceeds to step S102, in which a firing delay is calculated. The firing delay represents a delay from the ignition timing IGLOG to the firing timing. The ignition timing IGLOG is determined by an appropriate control and it is represented by the crank angle value. The firing delay can be calculated by subtracting the ignition timing IGLOG from the firing timing CA(x).

Step S103 through step S106 show a limit process for the firing delay. When any subsequent control process uses the firing delay, relatively larger variations may occur in the control process if the firing delay is not within a predetermined range. Therefore, the limit process is performed so that the firing delay is within the predetermined range. If the firing delay exceeds a predetermined upper limit value, the upper limit value is output as a firing delay (S104). If the firing delay is smaller than a predetermined lower limit value, the lower limit value is output as a firing delay (S106). If the firing delay is between the upper limit value and the lower limit value, the firing delay calculated in step S103 is output unchanged.

Based on the firing timing, various controls and/or parameter calculations are often performed. For example, the firing delay may be calculated as described above. Combustion duration to the time at which the in-cylinder pressure reaches a maximum value Pmax may be calculated from the firing timing. The firing timing may be controlled to a desired time point. The fuel amount or ignition timing may be controlled based on the firing timing. A control for smoothing the firing timing between all the cylinders may be performed so as to suppress variations in in-cylinder pressure maximum value between the cylinders. If the resolution of the firing timing is coarse, an error may be contained in the firing timing and hence the accuracy of these subsequent controls and/or parameter calculations may deteriorate. According to the present invention, not only the resolution of the in-cylinder pressure can be improved by the interpolation calculation shown in FIG. 8 but also the resolution of the firing timing can be improved by the interpolation calculation shown in FIG. 14 and FIG. 6. Because of these interpolation calculations, the firing timing can be identified with a higher accuracy without raising the sampling frequency for the in-cylinder pressure.

Figure 15:
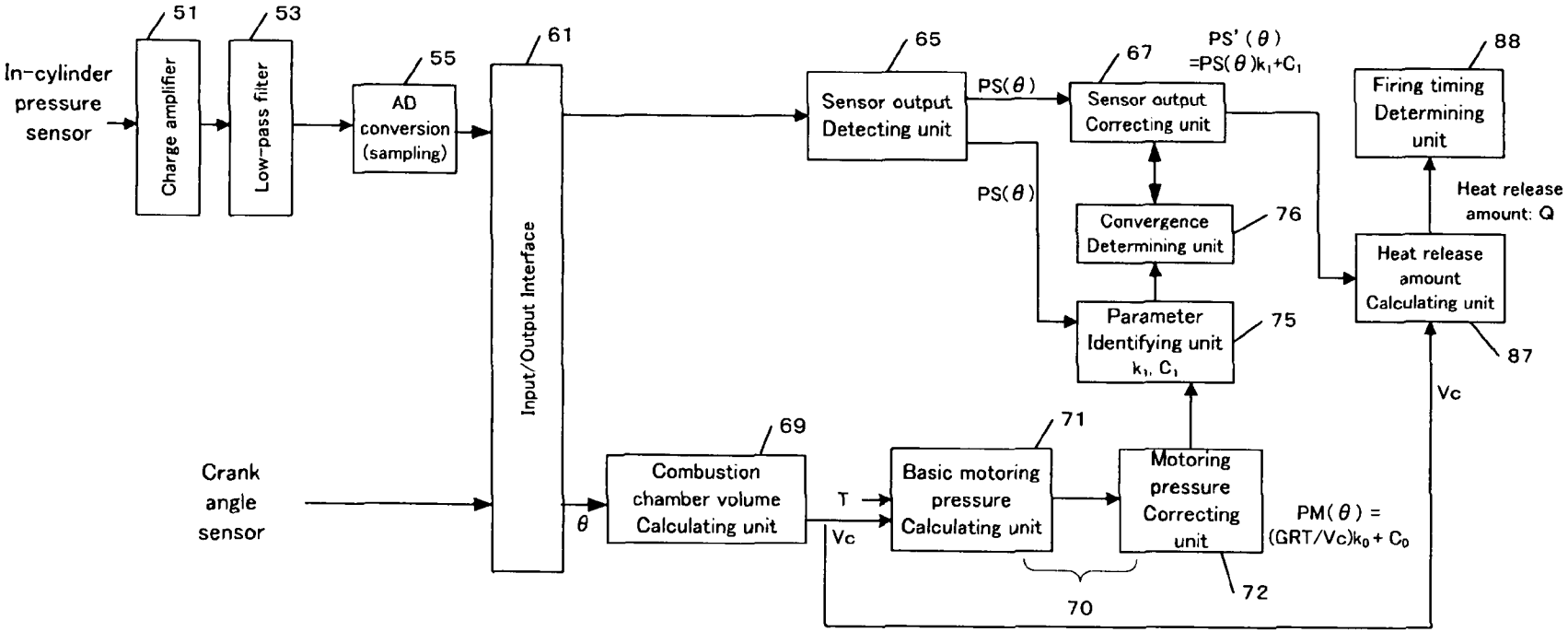
FIG. 15 is a functional block diagram of a control apparatus in accordance with another embodiment of the present invention.

FIG. 15 is a block diagram showing an overall structure of a control apparatus in accordance with another embodiment of the present invention. Each functional block is implemented in the ECU 1. Only different points from FIG. 4 will be described below. This embodiment is based on the second embodiment for the firing timing determination described referring to FIGS. 3(*b*) and 3(*c*). A heat release amount calculating unit 87 is provided in place of the pressure difference calculating unit 77.

The heat release amount calculating unit 87 calculates a heat release rate dQ/dθ(J/deg) according to the equation (15) based on the corrected in-cylinder pressure PS' (kPa) and then calculates a heat release amount Q(J) by integrating the heat release rate as shown in the equation (16). In these equations, κ represents the ratio of specific heat, Vc represents a combustion volume (cc) as described above and θ represents a crank angle degree as described above.

$$\frac{dQ}{d\theta}(\theta) = \left(\frac{\kappa(\theta)}{\kappa(\theta)-1} \times PS'(\theta) \times \frac{dVc}{d\theta}(\theta) + \frac{1}{\kappa(\theta)-1} \times Vc(\theta) \times \frac{dPS'}{d\theta}(\theta)\right) \times 10^{-3} \tag{15}$$

$$Q(\theta) = \sum \frac{dQ}{d\theta}(\theta) \tag{16}$$

The combustion volume Vc can be calculated in accordance with the above-described equation (2). As to the ratio of specific heat κ, a predetermined value may be used (for example, 1.3). Because the ratio of specific heat of the air-fuel mixture may change depending on the operating condition of the engine, the ratio of specific heat may be set to a value corresponding to the operating condition. For example, different values for the ratio of specific heat can be used between a fuel-cut time and a normal operating time. More specifically, during the period of the determination stage, data indicating a crank angle at which the fuel cut has been performed may be stored in the memory. By referring to the data in the memory, a first value of the specific heat ratio (for example, 1.3) is used when the fuel cut is performed and a second value of the specific heat ratio (for example, 1.4) is used when the fuel cut is not performed.

It should be noted that, in place of PS'(θ) in the equation (15), an average Pave(θ) of the corrected in-cylinder pressure over a predetermined range may be used.

A firing timing determining unit 88 detects, over the period of the determination stage, a time at which the heat release amount Q calculated by the heat release amount calculating unit 87 has exceeded a predetermined value QCPS. In response to the detection, the firing timing determining unit 88 uses an interpolation calculation to identify a time point at which the heat release amount Q has exceeded the value QCPS. The identified time point is determined as a firing timing.

Figure 16:
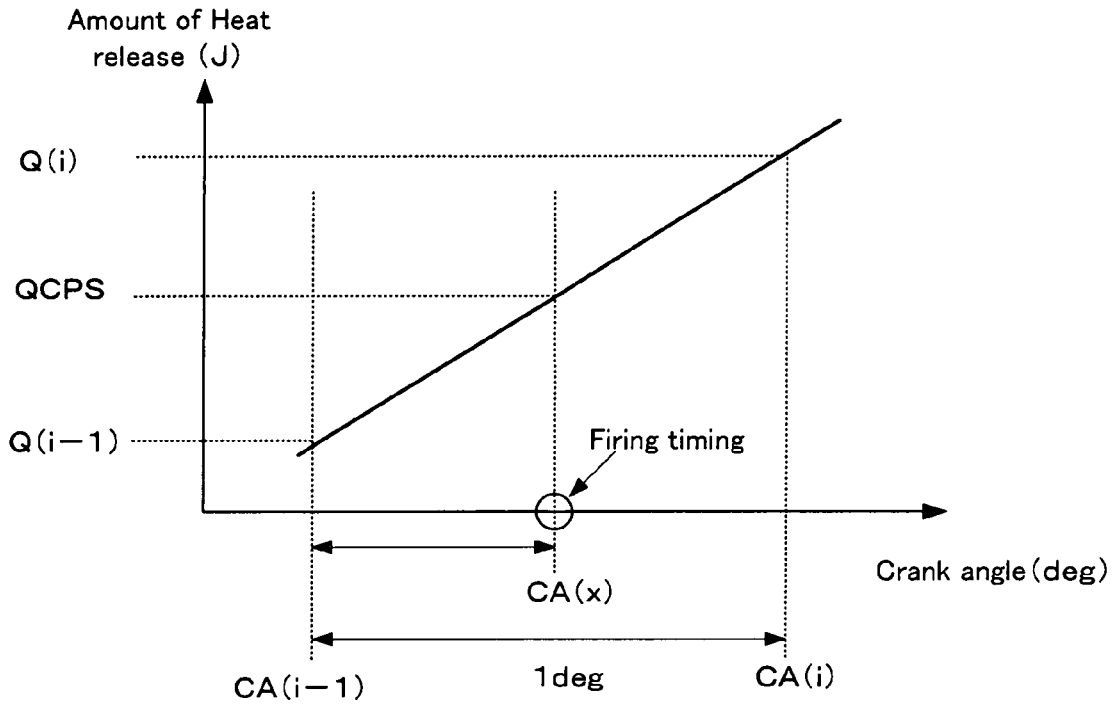
FIG. 16 is a diagram showing an interpolation calculation for identifying a firing timing with a finer resolution in accordance with another embodiment of the present invention.

Referring to FIG. 16, the interpolation calculation will be described. A first crank angle CA(i), shown in FIG. 16, is a crank angle at which the firing timing determining unit 88 detects that the heat release amount Q has exceeded the predetermined value QCPS. This fact indicates that the heat release amount Q has exceeded the predetermined value QCPS between the first crank angle and a second crank angle CA(i−1) that is previous to the first crank angle. A difference between the first crank angle CA(i) and the second crank angle CA(i−1) corresponds to a crank angle interval at which every in-cylinder pressure is calculated in the interpolation calculation by the sensor output detecting unit 65. For example, if the in-cylinder pressure for every one degree of crank angle is calculated by the sensor output detecting unit 65, the difference between the first crank angle CA(i) and the second crank angle CA(i−1) is one degree. The heat release amount corresponding to the first crank angle CA(i) is represented by Q(i) and the heat release amount corresponding to the second crank angle CA(i−1) is represented by Q(i−1).

The purpose of the interpolation calculation is to calculate a crank angle CA(x) at which the heat release amount Q reaches the predetermined value QCPS. As clearly seen in FIG. 16, the crank angle CA(x) can be calculated according to the equation (17). Thus, the firing timing determining unit 88 calculates the time point CA(x) and determines the calculated time point CA (x) as the firing timing.

$$CA(x) = \frac{(QCPS - Q(i-1))}{Q(i) - Q(i-1)} \times 1(deg) + CA(i-1) \tag{17}$$

Thus, the firing timing can be identified with a finer resolution than the resolution with which the in-cylinder pressure is calculated. When the in-cylinder pressure is calculated, for example, with a resolution of one degree of crank angle, the firing timing can be identified with a finer resolution than one degree of crank angle.

Alternatively, the resolution of the in-cylinder pressure calculated by the sensor output detecting unit 65 is not necessarily limited to one degree of crank angle. For example, in a case where the resolution is two degrees of crank angle, 1(deg) in the equation (11) is replaced with 2(deg).

Preferably, similarly to the first embodiment, if the determined firing timing is earlier than a predetermined value, the firing timing determining unit 88 prohibits an update operation for the firing timing because an error may be contained in the determined firing timing. In this case, the previous value for the firing timing is used in the subsequent processes that use the firing timing.

Furthermore, similarly to the first embodiment, if the firing timing determining unit 88 cannot identify a time point that is to be determined as the firing timing over the period of the determination stage, the unit 88 can determine that a misfire has occurred. Thus, presence/absence of a misfire can be determined in the firing timing determination process.

Figure 17:
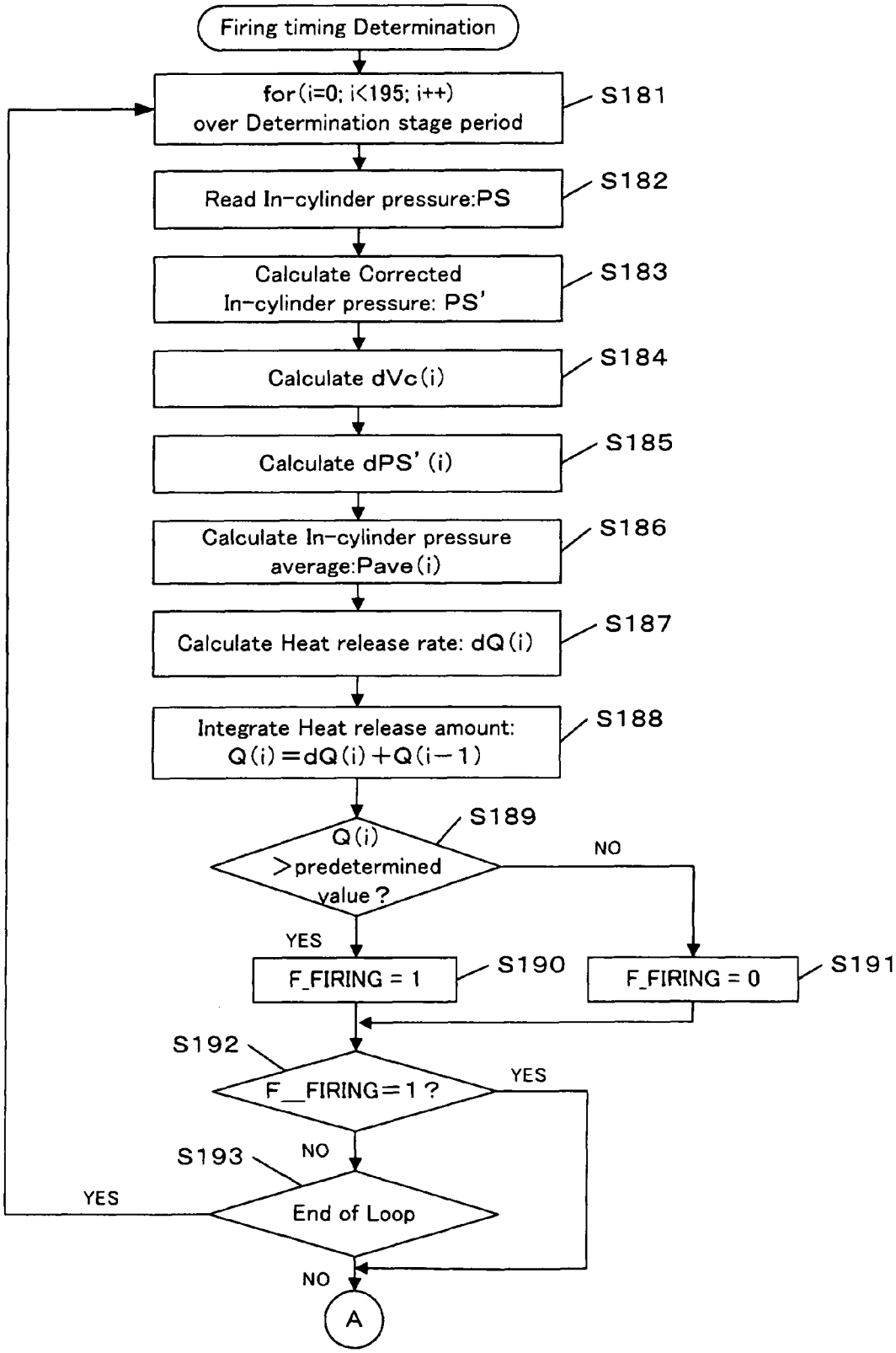
FIG. 17 is a flowchart of a firing timing determination process in accordance with another embodiment of the present invention.
Figure 18:
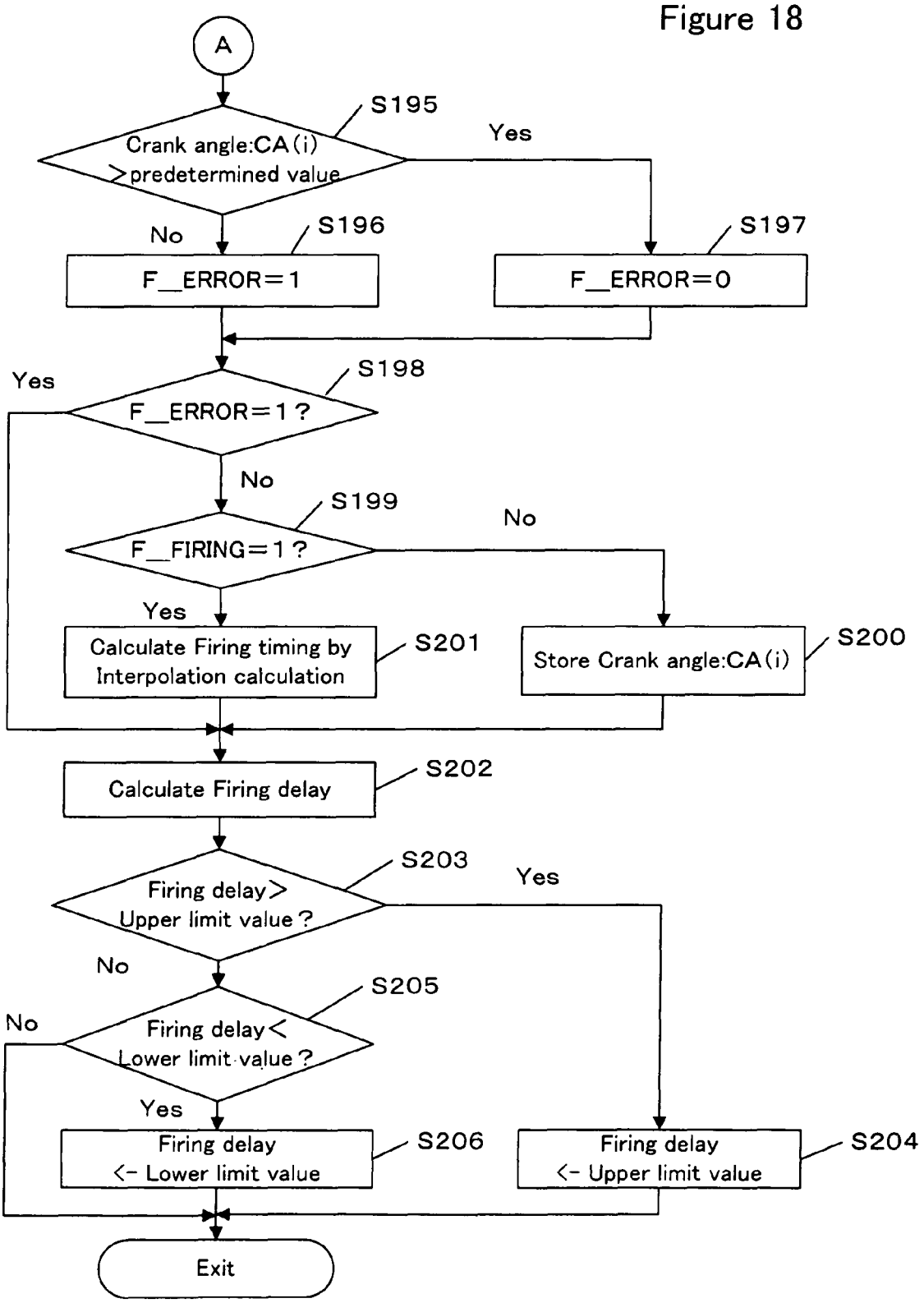
FIG. 18 is a flowchart of a firing timing determination process in accordance with another embodiment of the present invention.

FIG. 17 and FIG. 18 show a flowchart of a firing timing determination process in accordance with the embodiment shown in FIG. 15. Only different points from the process of FIG. 13 and FIG. 14 according to the first embodiment of the firing timing determination will be described below. Similarly to the embodiment of FIG. 13 and FIG. 14, among the in-cylinder pressure values for every predetermined crank angle (every one degree in this example) that have been calculated and stored in the memory by the process of FIG. 8, the in-cylinder pressure values in the period of the determination stage are selected. As described above, the other measurement values (such as intake air amount, intake air temperature, engine rotational speed and so on) have been acquired and stored in the memory at every predetermined crank angle (for example, at every 15 degrees) in the period of the determination stage. Calculation of the following equations is performed for each of the selected in-cylinder pressure values. Furthermore, measurement values corresponding to each in-cylinder pressure value are used. More specifically, the latest measurement values that have been already acquired at the time point (which can be identified by "time_1deg" of FIG. 9) corresponding to the in-cylinder pressure value are used.

Step S181 is the same as step S82 of FIG. 13, indicating that a loop is repeated the number of times corresponding to the number of the in-cylinder pressure values that have been calculated over the period of the determination stage by the process of FIG. 8. For example, if the determination stage is the above-described 195 degrees of crank angle, the loop is repeated 195 times (i=0 to 194) because the in-cylinder pressure value for every one degree of crank angle is calculated in FIG. 8.

In step S182, the in-cylinder pressure PS to be used for calculating a heat release amount is read. In step S183, a corresponding corrected in-cylinder pressure PS' is calculated in accordance with the above-described correction equation.

In step S184, dVc/dθ in the above-described equation (15) for calculating the heat release rate, that is, a combustion volume change rate dVc per crank angle is calculated. This rate can be calculated, for example, according to the equation (18). In this case, Vc(i) can be calculated in accordance with the equation (2) by using the crank angle θ corresponding to "i". The equation (18) is one example of a moving average process. Coefficient values such as 8 and 12 may be modified to any appropriate values.

$$dVc(i) = \frac{Vc(i-2) - 8Vc(i-1) + 8Vc(i+1) - Vc(i+2)}{12} \tag{18}$$

The equation (18) is only one example. dVc may be calculated by using another calculation equation. For example, it may be more simply calculated by using (Vc(i)−Vc(i−1))/2.

In step S185, dPS'/dθ in the above-described equation (15) for calculating the heat release rate, that is, a change rate dPS' of the corrected in-cylinder pressures per crank angle is calculated. This rate can be calculated, for example, according to the equation (19). The equation (19) is one example of a moving average process. Coefficient values such as 8 and 12 may be modified to any appropriate values.

$$dPS'(i) = \frac{PS'(i-2) - 8PS'(i-1) + 8PS'(i+1) - PS'(i+2)}{12} \tag{19}$$

The equation (19) is only one example. dPS'/dθ may be calculated by using another calculation equation. For example, it may be more simply calculated by using (PS'(i+1)−PS'(i−1))/2.

In step S186, an average Pave of the corrected in-cylinder pressure over a predetermined range is calculated. The average Pave can be calculated, for example, in accordance with the equation (20).

$$\text{Pave}(i) = \frac{PS'(i-4) + PS'(i-3) + PS'(i-2) + PS'(i-1) + PS'(i)}{5} \tag{20}$$

Although the equation (20) uses five corrected in-cylinder pressure values to calculate the average Pave, it is only one example. The average Pave can be calculated by using any number of corrected in-cylinder pressure values (for example, three values of PS'(i−1) to PS'(i+1)).

In step S187, the heat release rate per crank angle dQ is calculated in accordance with the equation (21). The equation (21) is basically the same as the equation (15), but it differs from the equation (15) in that Pave is used in place of PS'. As described above, the value of the specific heat ratio κ may be predetermined or may be set to different values depending on the operating condition of the engine.

$$dQ(i) = \left(\frac{\kappa(i)}{\kappa(i)-1} \times \mathrm{Pave(i)} \times dVc(i) + \frac{1}{\kappa(i)-1} \times Vc(i) \times dPS'(i)\right) \times 10^{-3} \quad (21)$$

In step S188, the heat release rate dQ(i) calculated in step S186 is added to the previous value Q(i−1) of the heat release amount to determine the current value Q(i) of the heat release amount.

In step S189, it is determined whether or not the heat release amount Q(i) has exceeded the predetermined value QCS. If it has exceeded QCPS, it is determined that the firing has started and a value of 1 is set in a flag F_FIRING (S190). If the decision of step S189 is No, a value of zero is set in the flag F_FIRING (S191).

After the value of 1 is set in the flag F_FIRING, the process exits the loop that starts from step S181 (S192). If the value of 1 is set in the flag F_FIRING, the crank angle CA(i) at the time at which the loop is terminated indicates a crank angle at which the firing has started. On the other hand, if the flag F_FIRING has not been set to 1 over the period of the determination stage, the loop is terminated with the value of the flag being kept at zero. In this case, the crank angle CA(i) at the time at which the loop is terminated indicates a crank angle corresponding to the end point of the determination stage.

The process shown in FIG. 18 is substantially the same as in FIG. 14 except for step S201. In step S201, the heat release amount Q(i) corresponding to the crank angle CA(i), the crank angle CA(i−1) that is previous by one predetermined crank angle interval to the crank angle CA(i), and the heat release amount Q(i−1) corresponding to the crank angle CA(i−1) are used to calculate the firing timing CA(x) in accordance with the interpolation calculation equation (17) that has been described above referring to FIG. 16. Thus, with the resolution that is equal to or finer than the resolution (one degree in this example) for the in-cylinder pressure of FIG. 8, the crank angle CA(x) at the time at which the heat release amount Q has exceeded the predetermined value QCPS can be identified as the firing timing. Accordingly, the firing timing can be identified with a resolution that is finer than the resolution (one degree in this example) for the in-cylinder pressure.

Figure 19:
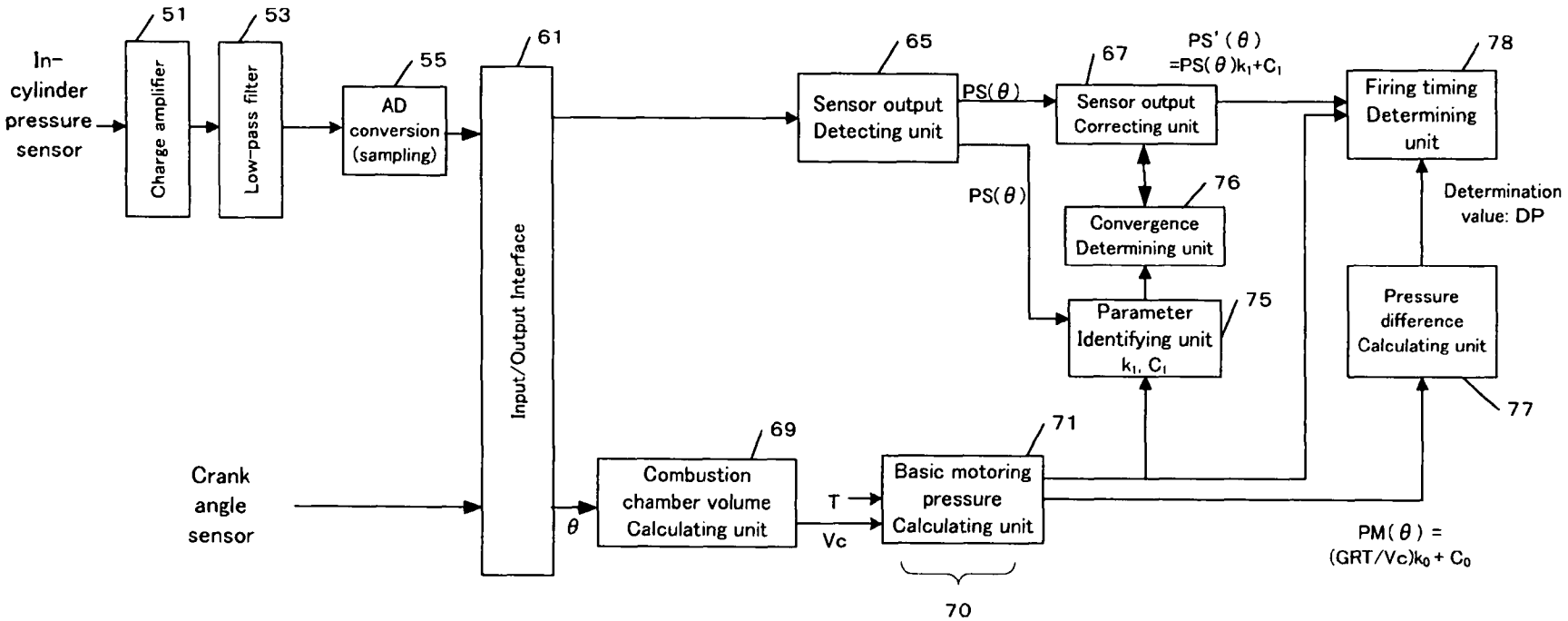
FIG. 19 is a functional block diagram of a control apparatus in accordance with another embodiment of the present invention.

FIG. 19 shows an alternative embodiment for the functional block diagram shown in FIG. 4. According to this alternative embodiment, the motoring pressure correcting unit 72 is not provided. The basic motoring pressure GRT/VC calculated in the basic motoring pressure calculating unit 71 is used as an estimated value PM of the motoring pressure based on the gas equation of the combustion chamber. Such an alternative embodiment can be established for the functional block diagram shown in FIG. 15 in a similar way.

Although the present invention has been described above with reference to the specific embodiments, the present invention is not limited to such specific embodiments but can be used for both a gasoline engine and a diesel engine. Furthermore, the present invention can be similarly used for a direct injection type of engine in which a fuel injection valve is provided to protrude into a combustion chamber.

It should be noted that although the process shown in FIG. 8 is used for the in-cylinder pressure in this embodiment, this process is similarly applicable to other measurement data (for example, detection value of the airflow meter, the exhaust gas sensor, the air/fuel ratio sensor or the like). A detection value for every predetermined crank angle (for example, every one degree) for the measurement data can be calculated through an interpolation calculation.

What is claimed is:

1. A control apparatus for determining a firing timing of an internal-combustion engine, comprising:

in-cylinder pressure detecting means for detecting an in-cylinder pressure at a predetermined time interval;

in-cylinder pressure calculating means for calculating an in-cylinder pressure for every predetermined crank angle based on the in-cylinder pressure detected at the predetermined time interval;

means for estimating a motoring pressure in a case where combustion is not performed in the engine;

detecting means for detecting that a pressure difference between the calculated in-cylinder pressure and the motoring pressure has exceeded a determination value; and firing timing identifying means for identifying, as a firing timing, a time point at which the pressure difference has exceeded the determination value with a finer resolution than the resolution of the predetermined crank angle by an interpolation calculation, the interpolation calculation using a first crank angle at which it is detected that the pressure difference has exceeded the determination value, the pressure difference corresponding to the first crank angle, a second crank angle previous to the first crank angle by the predetermined crank angle, and a pressure difference corresponding to the second crank angle, wherein a value equivalent to a predetermined ratio of the motoring pressure at a compression top dead center is used as the determination value.

2. The apparatus of claim 1, further comprising update prohibiting means for prohibiting update of the firing timing if a crank angle corresponding to the determined firing timing is earlier than a predetermined value.

3. The apparatus of claim 1, wherein the firing timing identifying means determines that a misfire has occurred if a time point to be identified as the firing timing is not found out over a predetermined period.

4. The apparatus of claim 2, wherein the firing timing identifying means determines that a misfire has occurred if a time point to be identified as the firing timing is not found out over a predetermined period.

* * * * *